US007833372B2

(12) United States Patent
Lenhardt

(10) Patent No.: US 7,833,372 B2
(45) Date of Patent: Nov. 16, 2010

(54) METHOD AND DEVICE FOR ASSEMBLING INSULATING GLASS PANES FILLED WITH A GAS DIFFERENT FROM AIR

(76) Inventor: Karl Lenhardt, Im Weidenfeld 8, D-75378 Bad Liebenzell (DE)

( * ) Notice: Subject to any disclaimer, the term of this patent is extended or adjusted under 35 U.S.C. 154(b) by 1094 days.

(21) Appl. No.: 10/590,843

(22) PCT Filed: Feb. 24, 2005

(86) PCT No.: PCT/EP2005/001930

§ 371 (c)(1),
(2), (4) Date: Sep. 11, 2006

(87) PCT Pub. No.: WO2005/080739

PCT Pub. Date: Sep. 1, 2005

(65) Prior Publication Data

US 2007/0175564 A1 Aug. 2, 2007

(30) Foreign Application Priority Data

Feb. 25, 2004 (DE) ..... 10 2004 009 860

(51) Int. Cl.
*E06B 3/24* (2006.01)

(52) U.S. Cl. ..... 156/109; 52/786.13; 52/786.1

(58) Field of Classification Search ..... 156/99, 156/109; 52/786.1, 786.13
See application file for complete search history.

(56) References Cited

U.S. PATENT DOCUMENTS 5,626,712 A 5/1997 Lisec
5,645,678 A 7/1997 Lisec
5,676,782 A 10/1997 Lisec
2007/0295441 A1 * 12/2007 Schuler ..... 156/109

FOREIGN PATENT DOCUMENTS

| | | |
|---|---|---|
| DE | 31 01 342 | 1/1981 |
| DE | 44 19 052 | 5/1994 |
| EP | 0 615 044 | 3/1994 |
| EP | 0 674 086 | 3/1995 |

* cited by examiner

*Primary Examiner*—Richard Crispino
*Assistant Examiner*—Christopher Schatz
(74) *Attorney, Agent, or Firm*—Orum & Roth LLC

(57) ABSTRACT

A method for assembling insulating glass panes filled with a gas different from air, by Arranging a first glass sheet and second glass sheet, provided with a spacer, in a vertical or inclined position so one is opposite to the other, without the first glass sheet being in contact with the spacer, Forming a chamber enclosing the space between glass sheets, by providing a belt at the lower edge of the glass sheet arrangement and at least one seal beside each of the upright edges of the glass sheet arrangement, which seal extends from a point above the belt down to the belt, Introducing a gas different from air into the chamber from below, closing the insulating glass pane by approaching the glass sheets one to the other once a desired filling grade or filing level has been reached.

50 Claims, 16 Drawing Sheets assembly device
buffer station
pairing station
feeder

A1
A2
B1
B2
C1
C2
D1
D2
E1
E2
F1
F2
G1
G2
H1
A1+2
B1+2
C1+2
1
1a
2
2a
20
26
30
31
32
40
55
56

METHOD AND DEVICE FOR ASSEMBLING INSULATING GLASS PANES FILLED WITH A GAS DIFFERENT FROM AIR

The present invention relates to a method having the features defined in the preamble of claim 1 and to a device having the features defined in the preamble of claim 29. A method of that kind and a device for carrying out such a method are known from EP 0 674 086 A1. In the case of the known method, a first glass sheet and a second glass sheet, carrying a spacer, and are placed upright on a horizontal conveyor, which uses a belt as a conveying element, are fed in upright position into the space between two pressure plates arranged at a variable spacing. Between the pressure plates, the glass sheets are positioned in parallel and in registration one to the other so that a continuous open gap remains around the spacer and the glass sheet arranged opposite to it. Adjacent the vertical edges of the glass sheets arranged in this way, seals are provided which are active between the pressure plates and which extend as far as to the upper run of the belt that closes the space between the glass sheets placed on them toward the bottom. The heavy gas is introduced into the chamber defined by the belt, the glass sheets, the two pressure plates and the vertical seals acting between the plates. The heavy gas rises in the chamber and its supply is stopped when a predefined filling level is reached. Then one of the pressure plates is approached to the other pressure plate for closing the insulating glass pane.

With respect to the introduction of the heavy gas, different possibilities are described in EP 0 674 086 A1:

The heavy gas is supplied either through openings in the vertical seals or through the belt that serves as conveying element. Both solutions are connected with disadvantages. When supplying the heavy gas from the side, movable gas supply devices, coupled with the movable seals, are needed which requires some apparatus input and which complicates the structure of the seals. Further, when the heavy gas is introduced from the side, it is difficult to uniformly displace the air between the glass sheets toward the top, and that difficulty increases with the length of the glass sheets. Introducing heavy gas through the belt is disadvantageous because that solution is incompatible with the main object of the belt, namely to transport the glass sheets and to close off the space between the glass sheets toward the bottom. EP 0 674 086 A1 does not disclose any practical possibility of supplying the heavy gas through a uniform belt. It describes a solution where two belts are arranged at a spacing one relative to the other on a channel, which is provided with upwardly directed openings arranged between the two belts. Heavy gas supplied through the channel is permitted to rise through the openings between the belts into the space between the glass sheets. It is a disadvantage of that solution that two separate belts have to be sealed and that the horizontal conveyor must permit transverse displacement in order to be adapted to glass sheets of different thickness and to insulating glass panes of different thickness.

Now, it is the object of the present invention to show how insulating glass panes, positioned between two plates of a vertical assembly device for insulating glass panes, can be filled with a gas different from air at little expense, uniformly and to a high filling level, and can then be closed.

This object is achieved by a method having the features defined in claim 1 and by a device having the features defined in claim 29. Advantageous further developments of the invention are defined in the sub-claims.

According to the invention, the insulating glass panes are filled with a gas different from air and, instead of being assembled in horizontal condition, are assembled in vertical or in an inclined position so that the gas different from air, especially a heavy gas with a specific weight greater than air, such as argon, can be introduced into the lower area of the insulating glass pane to be produced and can displace the air initially present between the glass sheets toward the top. If the flow is adequately slow and uniform, the air, having a lower specific weight, can be displaced toward the top floating on the heavier gas without getting excessively mixed with the heavy gas.

Production lines for insulating glass panes where the glass sheets, from which the insulating glass panes are assembled, are transported in upright position from one station of the production line to the next station of the production line, against an inclined supporting device, are generally described as "vertical" production lines.

In filling insulating glass panes with gas and assembling them from glass sheets arranged in vertical or inclined position, the invention teaches away from the prior art in that the glass sheets, arranged in pairs one opposite the other, do not stand on one belt during the filling operation; instead, only one of the glass sheets is in contact with the belt by its lower edge while a gap is formed between the belt and the lower edge of the other glass sheet through which a gas different from air can be introduced into the space between the two glass sheets. This provides essential advantages:

- The gap between the belt and the one glass sheet (hereinafter referred to as the "first" glass sheet) extends over the full length of the lower edge of the first glass sheet.
- Accordingly, a gas different from air can be introduced over the full length of the glass sheet arrangement.
- The gas therefore can rise uniformly from the bottom toward the top, over the full length of the glass sheet arrangement.
- The invention is suited not only for insulating glass panes with rectangular contour, but also for sheets with a non-rectangular contour, for example with a triangular contour or with curved edge portions. Such insulating glass panes are described as model panes.
- For purposes of the invention, a uniform tight belt can be used on which both glass sheets can be placed during the conveying operation in upright position not only one behind the other but also one beside the other.
- The belt may of course have a width greater than the thickness of the thickest insulating glass panes encountered in practice. Preferably, the belt has a width of between 100 mm and 140 mm.
- Due to the fact that the gap through which the gas different from air is supplied always extends at the lower edge of the first glass sheet, substantially uniform conditions are encountered according to the invention when gas is filled into insulating glass panes of different thickness. The belt, which preferably is the conveying element of a horizontal conveyor, therefore need not be adapted to insulating glass panes of different thickness, or to glass sheets of different thickness. This is an essential advantage compared with the prior art known from EP 0 674 086 A1 where the horizontal conveyor comprises two belts, running in parallel, between which the heavy gas rises from a supply channel. For, that known horizontal conveyor must be adapted to glass sheets and insulating glass panes of different widths by transverse displacement.
- The use of the uniform belt envisaged according to the invention permits the sheet arrangement to be easily sealed in downward direction during the filling operation: The belt in any case is in contact with the lower edge of the second glass sheet and seals the arrangement in that area. The belt extends to the lower edge of the first glass sheet and beyond that edge so that only the gap between the belt and the lower edge of the first glass sheet has to be sealed. This can be effected by an arrangement where the opening of a channel or an elongated nozzle, through which a gas different from air can be supplied, is provided at that gap. The channel or the nozzle can then be configured so as to close the gap between the belt and the lower edge of the first glass sheet on its rear, i.e. behind the surface of the first glass sheet opposite the second glass sheet. It is then possible, as known from the prior art, to provide seals between the upright edges of the glass sheet arrangement, which extend from a position above the belt down to the belt. The seals may be applied directly on the edges of the glass sheets. In that case, it is also possible to carry out the gas-filling operation outside of a press for insulating glass panes, where in most of the cases the insulating glass panes are positioned, filled with gas, assembled and pressed between two pressure plates. Preferably, however, the method according to the invention is carried out in a device for assembling and pressing insulating glass panes which comprises two plates, arranged at a variable spacing, between which the glass sheets are positioned in pairs one opposite the other and are closed—if desired after the gas-filling operation—by approaching the two glass sheets one to the other by reducing the spacing between the two sheets, until the first glass sheet comes to hit upon the spacer and to be bonded to the latter. A device of that kind normally is provided, near the lower edge of the plates, with a horizontal conveyor on which the glass sheets are transported in upright position, leaning against one of the plates, and on which the assembled insulating glass pane is discharged in upright position, leaning against one of the plates. According to the invention, the horizontal conveyor uses a belt as a conveying element.

Existing production lines for insulating glass panes can be retrofitted with a device according to the invention. Likewise, existing devices for filling in gas and for assembling insulating glass panes can be converted to a device according to the invention.

For carrying out the method according to the invention and for building a device according to the intention use can be made substantially of components and assemblies that have already proven their value in prior-art production lines for insulating glass panes. This allows the invention to be implemented in practice at low cost.

The invention permits uniform filling of insulating glass panes with a gas different from air at high filling grades and with comparatively low losses of gas.

Carrying out the invention permits shorter cycle times to be reached than has been possible before.

If the method according to the invention is carried out between the plates of a vertical device for gas-filling and assembling insulating glass panes, as indicated in claim 3, then the seals that are to be arranged beside the upright edges of the glass sheets may be applied to the edges of the glass sheets or to the two plates at a certain distance from the edges of the glass sheets. The possibility described last is preferred. Most conveniently, one positions a glass sheet pair at one of the ends of the plates and applies one of the movable seals to those ends of the plates. The other movable seal can then be displaced between the plates in the conveying direction of the belt for being positioned beside the upright edges of the glass sheets. However, the inconvenience connected with this way of proceeding can be avoided by providing a series of vertical sealing strips in one of the plates, which strips then can be advanced against the other plate and can be operated individually for this purpose. Compared with the movement of a seal in the conveying direction, the movement of such strips is only short and practically does not consume any cycle time. Of the entire number of sealing strips provided according to a further development of the invention, one always selects those strips that are the closest to the upright edge of the glass sheet pair to be filled with gas.

During the gas-filling operation, the glass sheets should be placed opposite one to the other in such a way that they can be connected to a closed insulating glass pane by approaching the glass sheets, especially by approaching the plates of the device for filling and assembling insulating glass panes, one to the other. This does not mean that they must be in registration and arranged in parallel one to the other already during the gas-filling operation, although that way of proceeding is preferred because it simplifies the motion sequence during assembly of the insulating glass pane (the only movement that has to be carried out is a linear parallel displacement) and because it is likely to reduce the consumption of gas.

The gap between the belt and the one glass sheet, through which the gas different from air is filled in, can be formed in various ways. One of such ways consists in lifting the glass sheet off the belt. This can be effected using the plate against which the glass sheet leans. In a gas-filling and assembling device for insulating glass panes, the plates usually are provided with holes through which air can be selectively blown or sucked.

Blowing will produce an air cushion between the plate and a glass sheet leaning against it, on which the sheet can smoothly slide while being transported. For fixing a glass sheet on such a plate, it is attached to the latter by suction. For lifting a glass sheet off the belt, the glass sheet may initially be attached to the plate by suction and may then be lifted off by shortly lifting the plate, for example with the aid of pneumatic cylinders. Another possibility consists in pivoting the plate about an axis extending below the belt, in parallel to the conveying direction, an operation that will be explained in more detail further below. Another possibility to form a spacing between the lower edge of the glass sheet and the belt consists in pivoting the belt in downward direction, about an axis extending in parallel to the conveying direction, for which purpose a pivot angle of a few degrees will be sufficient. Conveniently, the pivot axis extends at the lower edge of the other glass sheet. The described possibilities to form a spacing between the lower edge of a glass sheet and the belt can also be used in combination.

In order to permit the glass sheets to be fixed on the plates, it is preferred that the sheets are in surface contact with the plates.

For carrying out the invention, either the first glass sheet or the second glass sheet, provided with a spacer, may be positioned with its lower edge spaced a certain distance from the belt. Preferably, the first glass sheet, which does not carry a spacer, is selected for that purpose. This permits the gas to flow into the space between the glass sheets along the shortest possible path, directly behind the edge of the first glass sheet, and the conditions encountered by the gas are always approximately the same, for all imaginable thicknesses of insulating glass panes.

For introducing the gas different from air into the space between the glass sheets, it is generally possible to introduce an elongated nozzle laterally into the gap between the belt and the edge of the first glass sheet, which latter has been arranged at a spacing from the belt. However, the apparatus input necessary for this procedure can be avoided by providing, according to a further development of the invention, that the gas is introduced through the plate on which the glass sheet remote from the belt, especially the first glass sheet, has been placed. The supplying means for the gas is then always located at the place where the gas is needed, for all imaginable formats of insulating glass panes, without any need for a special feed motion. In this connection, it is preferred to guide the gas in the plate so that it will exit from the bottom of the plate where it will impinge upon the belt and will be deflected by the latter and directed into the space between the two glass sheets. It is then only necessary to provide a seal behind the one or more gas discharge openings at the bottom of the plate, which seal advantageously may consist of an inflatable hose that extends over the full length of the plate and may most conveniently be arranged in a groove into which it can be withdrawn in its inoperative condition and from which it may emerge when it is inflated so as to contact the oppositely arranged belt when sealing is needed.

In an assembly device for insulating glass panes, both plates may be movable. A device with such an arrangement is illustrated in EP 0 615 044 A1. In usual assembly devices for insulating glass panes, however, only one of the two plates is movable, while the other is stationary. In that case, it is preferred according to the invention to supply the gas different from air through the movable plate. For, the movable plate is best suited for receiving and fixing the first glass sheet, which is not yet provided with a spacer.

In a known vertical assembly device for insulating glass panes, the horizontal conveyor is aligned in such a way that a right angle is enclosed between its conveying element or conveying elements and the surface of the plates. This is the case also with the device known from EP 0 674 086 A1, where the upper run of the belt is aligned at a right angle relative to the plate surfaces facing each other so that the glass sheets are in full-surface contact with the plates and are conveyed and positioned with their lower edges standing on the belt in full-surface contact. The invention prefers, however, a different solution according to which the belt of the horizontal conveyor and the plates, instead of being arranged at a right angle, are provided in inclined positions one relative to the other so that, specifically, the angle enclosed between the upper run of the belt and the surface of the stationary plate is larger than 90°. An arrangement where the upper run of the belt extends horizontally not only in its conveying direction but also in transverse direction to the latter is especially preferred. In the case of an inclination of 6° relative to the vertical line, which is normal for the plates of usual assembly devices for insulating glass panes, the angle between the upper run of the belt and the stationary plate then is 96°. As a result, the glass sheet leaning in full-surface contact against the plate will no longer rest on the belt with the full surface of its lower edge, but only with its outer edge which will impress itself into the belt, thereby providing efficient sealing. Usually, the belt comprises a layer made from of a low-wear elastomeric material, such as the polyurethane known under the trade name Vulkollan. Another advantage of such an arrangement lies in the fact that the friction contact between the glass sheet and the belt is improved so that the risk of slippage between the glass sheet and the belt is diminished during the conveying operation, with the result that improved positioning accuracy can be achieved for the glass sheets.

However, there is also the possibility that has been described before, namely to initially arrange the upper run of the belt at a right or an approximately right angle relative to the two plates and to then pivot the belt in downward direction about an axis extending in parallel to the conveying direction, before the gas different from air is supplied, in order to open a gap for the supply of the gas or to increase an already existing gap.

The operation of conventional assembly devices for insulating glass panes mostly is such that only one of the two plates is movable and that the movable plate can be moved only in parallel to itself and perpendicularly to the stationary plate. In such a device, two glass sheets are positioned one opposite to the other by initially conveying the first glass sheet, leaning against the stationary plate, and stopping that sheet in a predetermined position. Thereafter, the movable plate moves toward the first glass sheet, grips the latter by suction and then returns to its initial position together with the first glass sheet attached to it. The second glass sheet, leaning against the stationary plate, is transported into the device and positioned in registration with the first glass sheet only upon completion of that process. The invention prefers, however, a different way of proceeding where the plates initially are arranged in V form so that the first and the second glass sheets, arranged in V form, are simultaneously fed into the space between the plates and are stopped in a predetermined position without changing their arrangement in V form in which they had been positioned one relative to the other. The time required for transferring the first glass sheet from the stationary plate to the movable plate can be saved in the assembly device, which is an important factor because the assembly device is the slowest device in a production line for insulating glass panes, especially when a gas-filling operation is integrated in the line.

A way of arranging the first and the second glass sheets in V form one opposite the other, outside of the assembly device for insulating glass panes, and of then feeding them simultaneously into the assembly device, has been disclosed in the patent application WO 2005/080734 A3 entitled "Method for positioning glass sheets in a vertical assembly and press device for insulating glass panes", filed the same day by the same inventor, to which reference is herewith expressly made. A combination of the two inventions offers considerably advantages.

Once two glass sheets, arranged in V form, have been transported and positioned between the plates, the movable plate may be approached to the stationary plate by pivoting it a bout an axis extending in parallel to the conveying direction. The position of the pivot axis preferably is selected so that the first glass sheet, being held on the plate to be pivoted, will be lifted off the belt by the pivoting movement. Preferably, the plate is pivoted into an intermediate position parallel to the opposite plate. The gas-filling operation preferably is carried out in that intermediate position. Starting out from that intermediate position, the pivoting plate is then displaced in parallel to itself and vertically to the stationary plate and approached to the latter in a manner known as such whereby the insulating glass pane is closed. The pivoting operation and the parallel displacement of the pivoting plate may in some cases also be carried out simultaneously. During the last phase of the assembly operation, the two plates should however by aligned in parallel one to the other. In order to ensure that the glass sheet will be lifted off the belt, the position of the axis, about which the movable plate is pivoted, should be selected so that the axis will not extend above the upper run of the belt. Preferably, it extends below the upper run of the belt close to alignment with the surface of the stationary plate against which the movable plate is to be pivoted.

In the case of a pivoting movable plate, the latter has an initial position in which the two plates are arranged in V form one relative to the other. In that initial position, the two plates conveniently should enclose with the upper run of the belt an equal angle, especially an angle of 95° or 100°, in particular of approximately 96°, which is an inclination that has proven its value in production lines for insulating glass panes. When oriented in that V form, the lower edges of the two glass sheets of a glass sheet pair are in contact with the belt not by their full surface, but only by their outer edges, which provides the advantages described above.

If, as is preferred, the glass sheets are arranged in V form one opposite the other already outside of the assembly device for insulating glass panes, then special advantages can be derived if not only a single glass sheet pair, but two or more than two glass sheet pairs are arranged outside of the assembly device in close succession and in V form one opposite the other, and if the pairs arranged in this way are then transported jointly and in synchronism into the assembly device, for placing them in the device in parallel arrangement, introducing a gas different from air and then jointly closing the sheets. This makes the operation very efficient. As assembly devices for insulating glass panes generally have a length of 4 m or even more in order to permit even very large insulating glass panes to be assembled, while most of the insulating glass panes have a length of less than 1 m, such a development of the invention allows the assembly device to be utilized much more efficiently than has been possible before. This provides additional advantages in connection with the present invention; due to the fact that the glass sheets are placed on their outer edges, an improved sealing effect is achieved, and due to the pivotal movement of the movable plate, the respective first glass sheet is lifted off without difficulty, and this in a gentle way because when being lifted off the belt, the sharp glass edge does not wear the belt during the assembly movement.

In order to ensure that the conveying task and the sealing task can be efficiently performed by the belt, the upper run should be supported over its length. This can be achieved by a series of rollers, arranged in close succession, on which the belt runs. Preferably, however, the upper run of the belt is supported by a rail that permits the lower edge of the glass sheets to be supported and sealed more efficiently.

In the case of the device according to the invention, the means for supplying the gas different from air are preferably provided on or in one of the plates and, consequently, need not be moved, by a movement separate from the movement of the plate, to the gap between the belt and the bottom of the one glass sheet in order to permit the gas to be introduced between the plates. Preferably, the gas different from air is supplied through the plate that serves to hold the first glass sheet on which no spacer is provided. Preferably, one or more exit openings for the gas are provided at the bottom of the respective plate so that the gas exits in the direct neighborhood of the lower edge of the glass sheet, where the filling gap is formed, and is then deflected into the space between the glass sheets by the belt.

Since as a rule insulating glass panes of different lengths are assembled and filled with a heavy gas in the device, a channel which preferably extends in the conveying direction and which is subdivided into several sections, is preferably provided for the supply of heavy gas. The gas can be supplied separately to the different sections into which the channel is subdivided, and each section of the channel communicates with one or more exit openings, exclusively associated to the respective section, which are arranged in the neighborhood of the gap between the belt and the one glass sheet, especially at the bottom of the respective plate. In operation of the device, the gas is then supplied only to those sections of the channel which have all their exit openings located beside an insulating glass pane to be filled.

According to a modified embodiment, a channel extending over the full length of the plate in the conveying direction may be provided on or in the respective plate if branch ducts issue from that channel that can be shut off separately and that lead to exit openings arranged in the gap between the belt and the one glass sheet, especially at the bottom of the respective plate. When filling in gas, all branch ducts that lead to exit openings not located beside an insulating glass pane to be filled then remain shut off.

In order to seal the filling gap, it is recommended to arrange the exit openings for the gas near the front surface of the respective plate, between the front surface and a seal extending lengthwise in the conveying direction and directed against the belt or against a rail supporting the belt. Such seals may be provided with advantage between both plates and the belt or the rail supporting the belt, for example at the bottom of the plates.

The sealing effect on the side of the horizontal conveyor that faces away from the filling gap can be improved if the upper run of the belt is supported over its full length by a rail which is connected over its full length with the neighboring plate, especially the stationary plate, solidly and in gastight fashion. However, there is also the possibility to have the upper run of the belt supported over its full length by a rail that projects laterally beyond the belt, and to provide a seal, directed against the opposite bottom of the plate, at least on one side of the belt, more conveniently on both sides of the belt, on the upper surface of the rail or in a groove of the rail. This is more favorable than providing a seal in a groove in the bottom of the respective plate as it makes it easier—in a way that will be described hereafter—to seal the vertical edges of the insulating glass panes to be assembled.

Especially well suited as lengthwise seals are hoses, for example such hoses which due to their inherent elasticity can be compressed against the action of a restoring force, but especially hoses of a kind that can be inflated and retracted by evacuation.

Preferably, the respective plate is provided, between two exit openings through which the heavy gas can be supplied independently, with a slide which can be moved from the top to the bottom and which extends transversely to the conveying direction from the front surface of the plate to a seal, extending in the lengthwise direction, provided between the bottom of the respective plate and the belt or a rail supporting the belt. That slide can be moved down until it hits against the upper run of the belt, for forming between the bottom of the respective plate and the belt a barrier to prevent losses of gas which otherwise could occur at the bottom of the plate, in the conveying direction or against the conveying direction.

The chamber to be filled with heavy gas is vertically delimited on the one hand by a seal, especially a strip or a flap, provided on one of the ends of the plate which seal conveniently extends over the full height of the plates and can be applied to the edge of both plates. The other end of the chamber to be filled with heavy gas is conveniently delimited by one of a plurality of seals that are provided in spaced arrangement one to the other in vertical slots of one of the two plates and can be moved separately and independently one from the other out of their vertical slots and into contact with the opposite plate. Conveniently, the vertical seals are arranged exactly opposite the slides provided in the opposite plate, but not opposite to one of the exit openings.

The vertical seals arranged in the plate may take the form of strips which need not be much wider than the space between the two plates maximally encountered during the gas-filling operation. The seals can be advanced separately from the rear of the plate, for example by means of pneumatic cylinders. In order to achieve adequate sealing with respect to the belt and the rail supporting the belt, which may project laterally beyond the belt, an adaptive sealing element, especially a brush with downwardly directed bristles, is preferably provided at the bottom of the strips. It has been found that such a brush has a long service life and guarantees sufficient tightness.

Certain embodiments of the invention are shown in the attached drawings, partially in diagrammatic form. Identical or corresponding parts used in the different drawings are designated by the same reference numerals. Those parts of the assembly device, which have been described as plates in the general part of the description, will be described as pressure plates in the description of the drawings, being suited for pressing the insulating glass panes.

Figure 1:
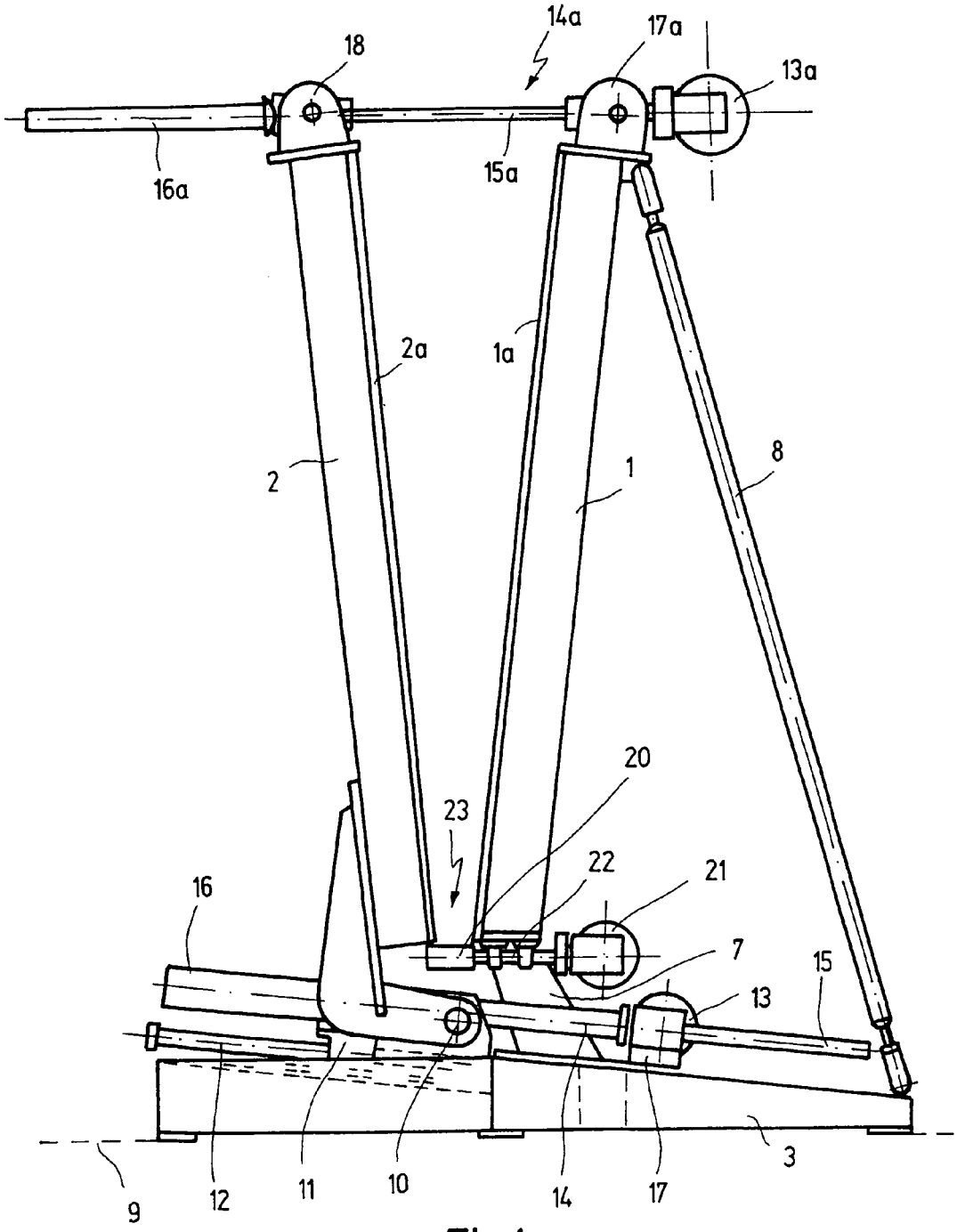
FIG. 1 shows a side view of a pairing station with supporting devices arranged in V form one relative to the other.

The pairing station illustrated in FIGS. 1 to 5 comprises two oppositely arranged supporting devices 1 and 2 provided on a frame 3. Each of the two supporting devices 1 and 2 comprises plates 1*a* and 2*a*, respectively, which are provided with passage holes 4 at many points distributed over the plates, which passage holes are covered by a hood 5 at the rear of the respective plate 1*a*, 2*a*, respectively, which hood is connected with a blower—not shown—by which air can selectively be blown into the chamber 6 formed below the hood 5, or be removed from the chamber 6 by suction.

The first supporting device 1 stands on a base 7 which is firmly connected with the frame 3; the rear of its upper end is supported on the frame 3 via struts 8. The arrangement is such that the plate 1*a* is inclined to the rear, relative to the vertical line, by an angle of 6°, for example. The horizontal floor on which the frame 3 is located is indicated by reference numeral 9.

Figure 2:
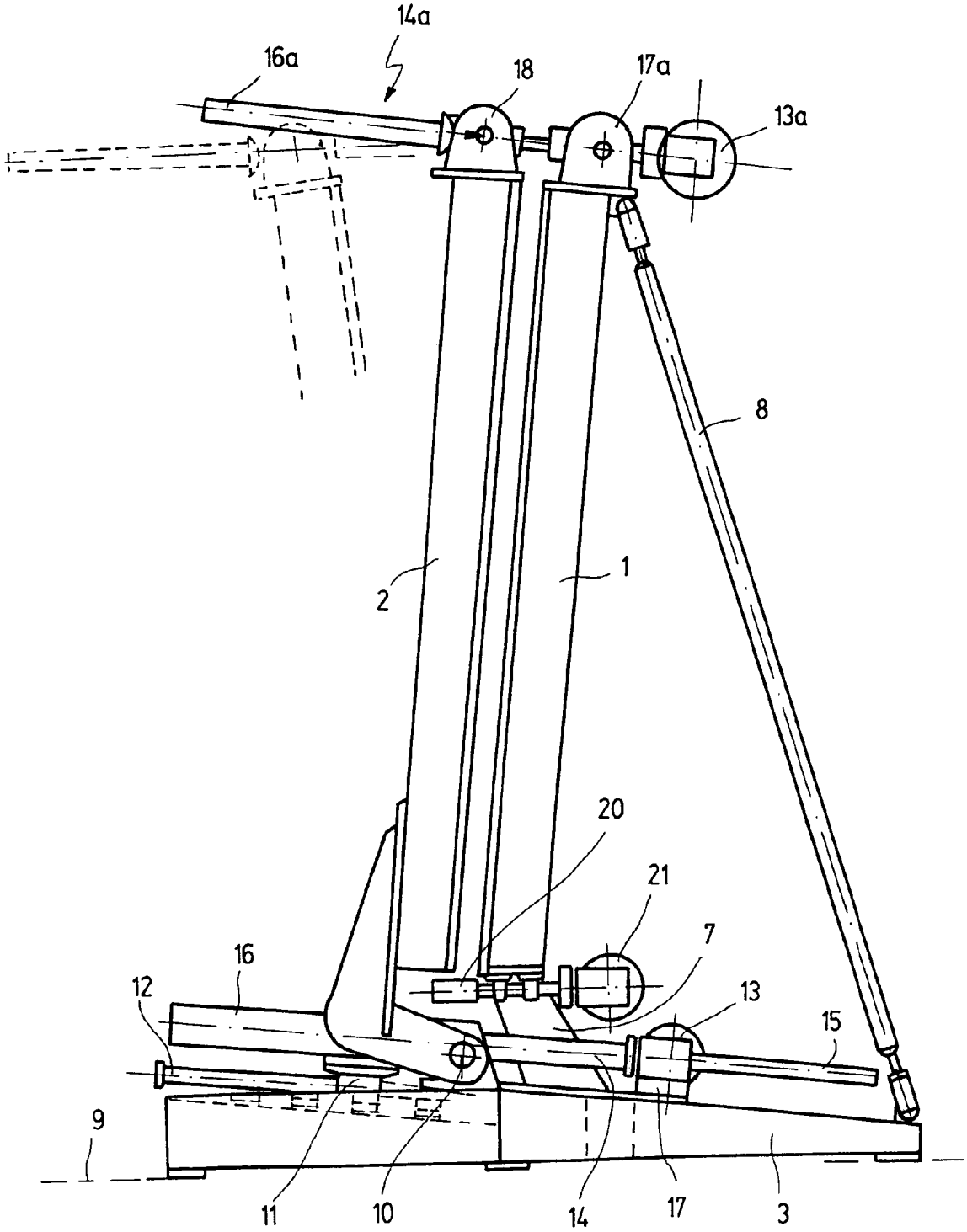
FIG. 2 shows a view of a that pairing station similar to FIG. 1, but with the supporting devices placed upright and in parallel one to the other.
Figure 3:
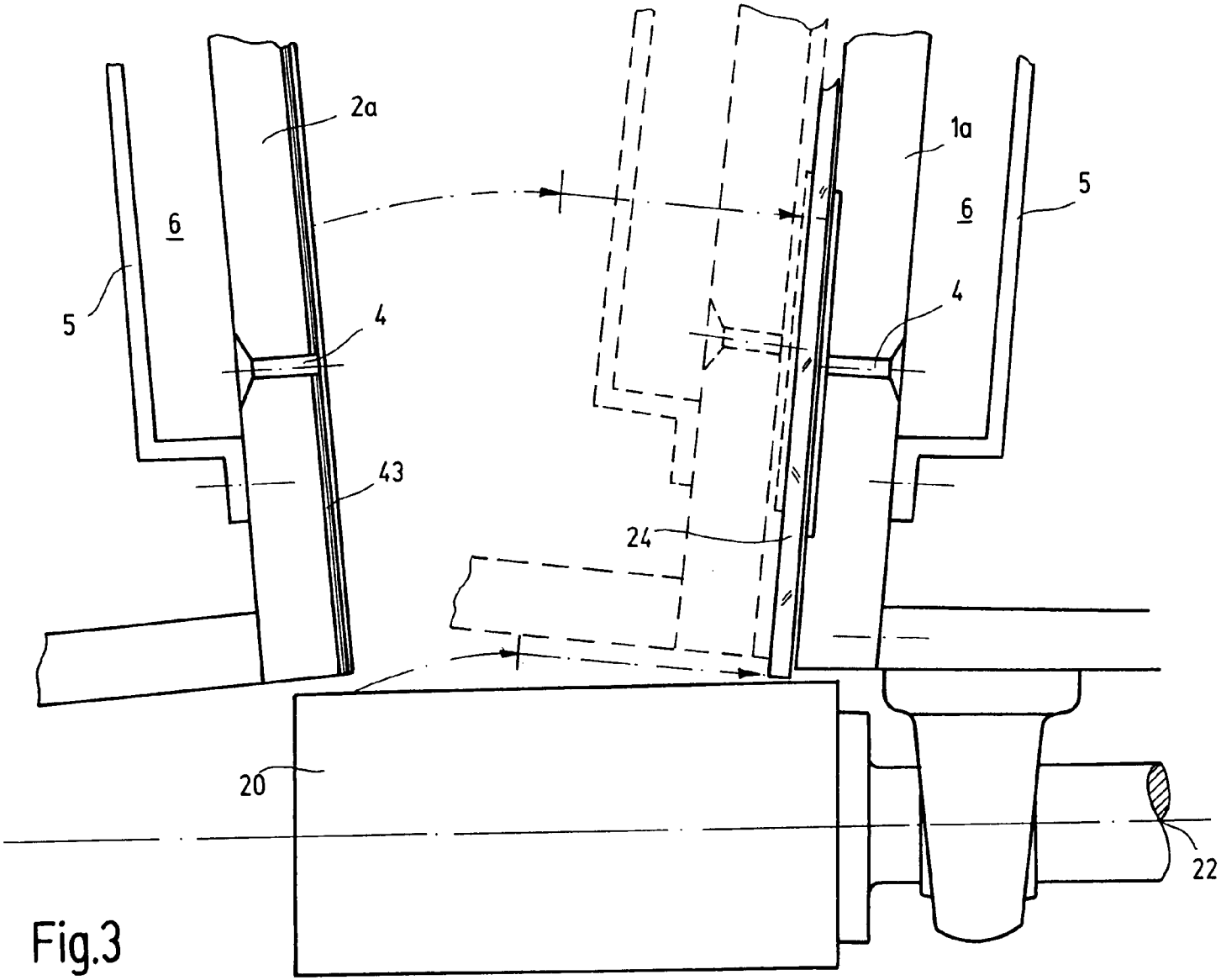
FIG. 3 shows a vertical section, enlarged relative to FIG. 1, through a detail of the lower area of the pairing station with its supporting devices arranged in V form and a glass sheet leaning against one of those devices.

The second supporting device 2 is mounted on a carriage 11 for pivotal movement about an axis 10 that extends perpendicularly to the drawing plane in FIGS. 1 and 2, the carriage being arranged for linear displacement along rails 12, which extend in vertical planes relative to the pivot axis, and which are inclined relative to the horizontal line 9 by the same angle by which the plate 1*a* is inclined relative to the vertical line. Accordingly, the carriage 11 can be displaced in a direction perpendicular to the plate 1*a*. Displacement of the carriage 11 is brought about by a motor 13 that drives a spindle 15 of a spindle gearing 14 whose spindle nut is located in a housing 16 and is connected with the carriage 11 for pivotal movement about a horizontal axis extending in parallel to the conveying direction. The spindle 15 is likewise seated in a holder 17 mounted on the frame 3, with its axis extending in parallel to the conveying direction.

The upper ends of the supporting devices 1 and 2 are connected one with the other by a further spindle gearing 14*a* whose spindle 15*a* is pivotally seated in a holder 17*a* mounted on the first supporting device 1 and is driven by a motor 13*a*. The associated spindle nut is accommodated in a housing 16*a* and is seated for pivotal movement in a holder 18 mounted on the movable supporting device 2. The spindle gearings 14 and 14*a* are provided in duplicate, preferably in the neighborhood of the four corners of the rectangular contour of the plates 1 and 2*a*.

By driving the spindles 14*a*, the second supporting device 12 can be pivoted from its initial position illustrated in FIG. 1, in which the plates 1*a* and 2*a* are arranged one opposite the other in V form at an angle of 12°, for example, into the intermediate position illustrated in FIG. 2 in which the movable plate 2*a* is arranged opposite and in parallel to the plate 1*a*, preferably at a spacing of 5 cm to 7 cm. From the intermediate position illustrated in FIG. 2, the movable supporting device 2 can then be further approached to the stationary supporting device 1, by synchronous activation of the lower and the upper spindles 15 and 15*a*, during which operation the parallel arrangement of the two elements remains unchanged.

A horizontal conveyor 20 mounted on the lower edge of the stationary supporting device 1 can be driven by a motor 21. The horizontal conveyor 20 is a first track of a horizontal conveyor, composed from a plurality of tracks, that extends through the entire production line in which the invention is to be implemented. The track may consist of a line of rollers having cylindrical lateral surfaces and mutually parallel horizontal rotary axes arranged between the two supporting devices 1 and 2, the widths of the rollers being sufficiently great—preferably 10 cm to 12 cm—to bridge the gap 23 existing in the initial position of the movable second supporting device 2 at the lower edge of the plates 1*a* and 2*a*. Due to the fact that the axes 22 of the rollers of the horizontal conveyor 20 extend in a horizontal plane, they enclose with the plates 1*a* and 2*a* identical angles of, for example, 96° in the initial positions illustrated in FIG. 1.

The horizontal conveyor 20 may be formed not only by a line of rollers that can be driven in synchronism, but also by a belt 20*a*, especially by a toothed belt, that can be driven by the motor 21 via a driving wheel, especially a gear. In order to prevent sagging, such a belt 20*a* is supported on a series of free-wheeling rollers or on a horizontal rail on which the upper run of the belt 20*a* is permitted to slide.

The pairing station can be supplied with separate glass sheets 24 and 25 by a feeder 26 which substantially consists of a horizontal conveyor aligned with the horizontal conveyor 20 and a supporting device the front of which is aligned with the front of the first supporting device 1 in the pairing station. The feeder 26 is illustrated diagrammatically in FIGS. 7 to 10.

In order to position two glass sheets 24 and 25 in registration and opposite one to the other, in V form, a first glass sheet 24 is initially transported by the feeder 26 into the pairing station where it is stopped in a predefined first position, in contact with the first supporting device 1, preferably in a position in which the forward edge of the first glass sheet 24 comes to lie near the forward end of the first immovable plate 1*a*. During the feeding motion, air is blown into the chamber 6 that exits through the holes 4 to produce an air cushion between the plate 1*a* and the first glass sheet 24, which permits the first glass sheet 24 to move at low friction during the feeding motion and which at the same time acts to hold the glass sheet in contact with the plate 1*a* due to the vacuum produced in the air cushion. Once the first glass sheet 24 has reached its predefined fist position, no further air is blown into the chamber 6.

Figure 4:
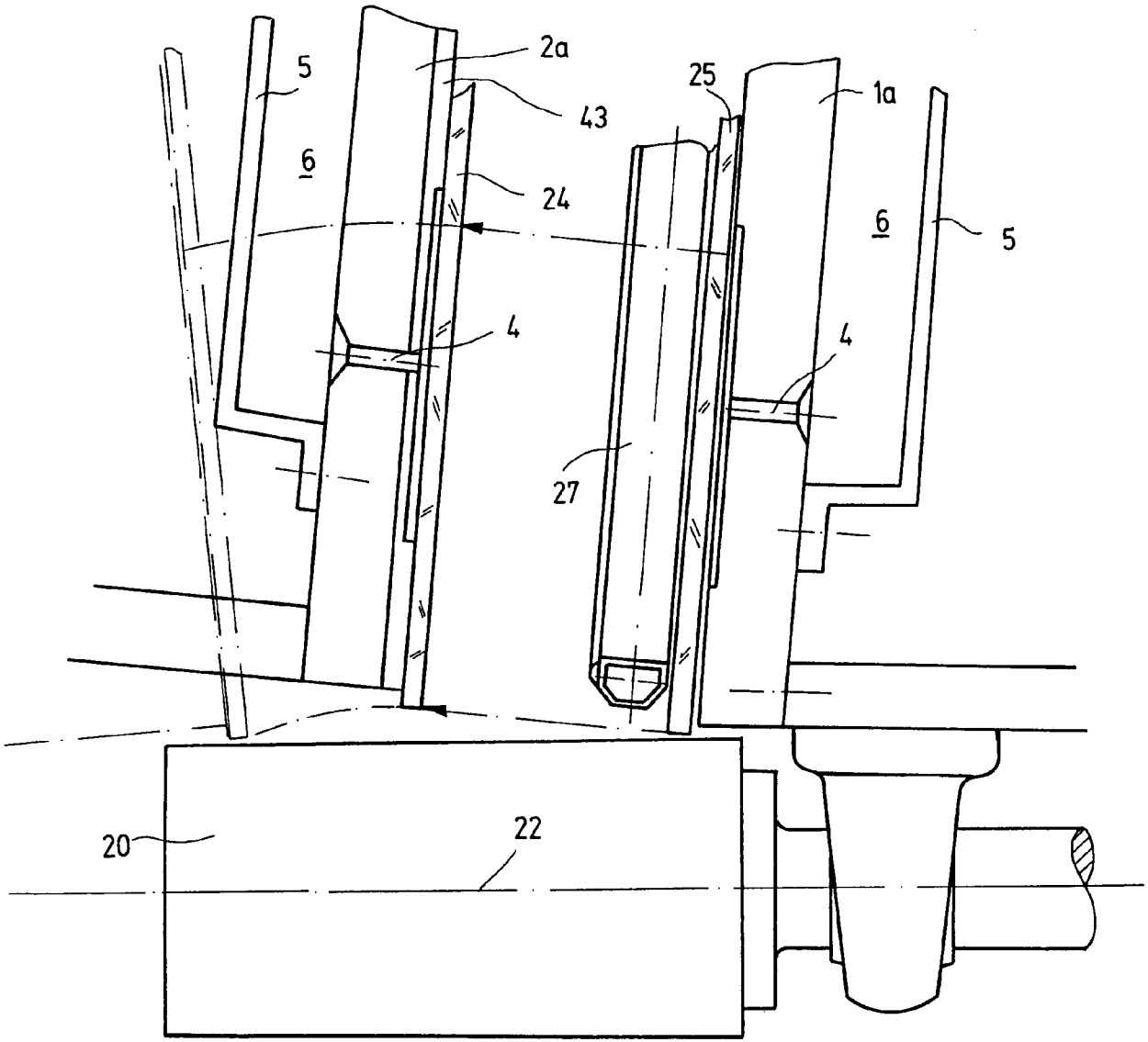
FIG. 4 shows a representation of the pairing station similar to that of FIG. 3, but with the supporting devices arranged in parallel one opposite the other, with a glass sheet in contact with both devices.
Figure 5:
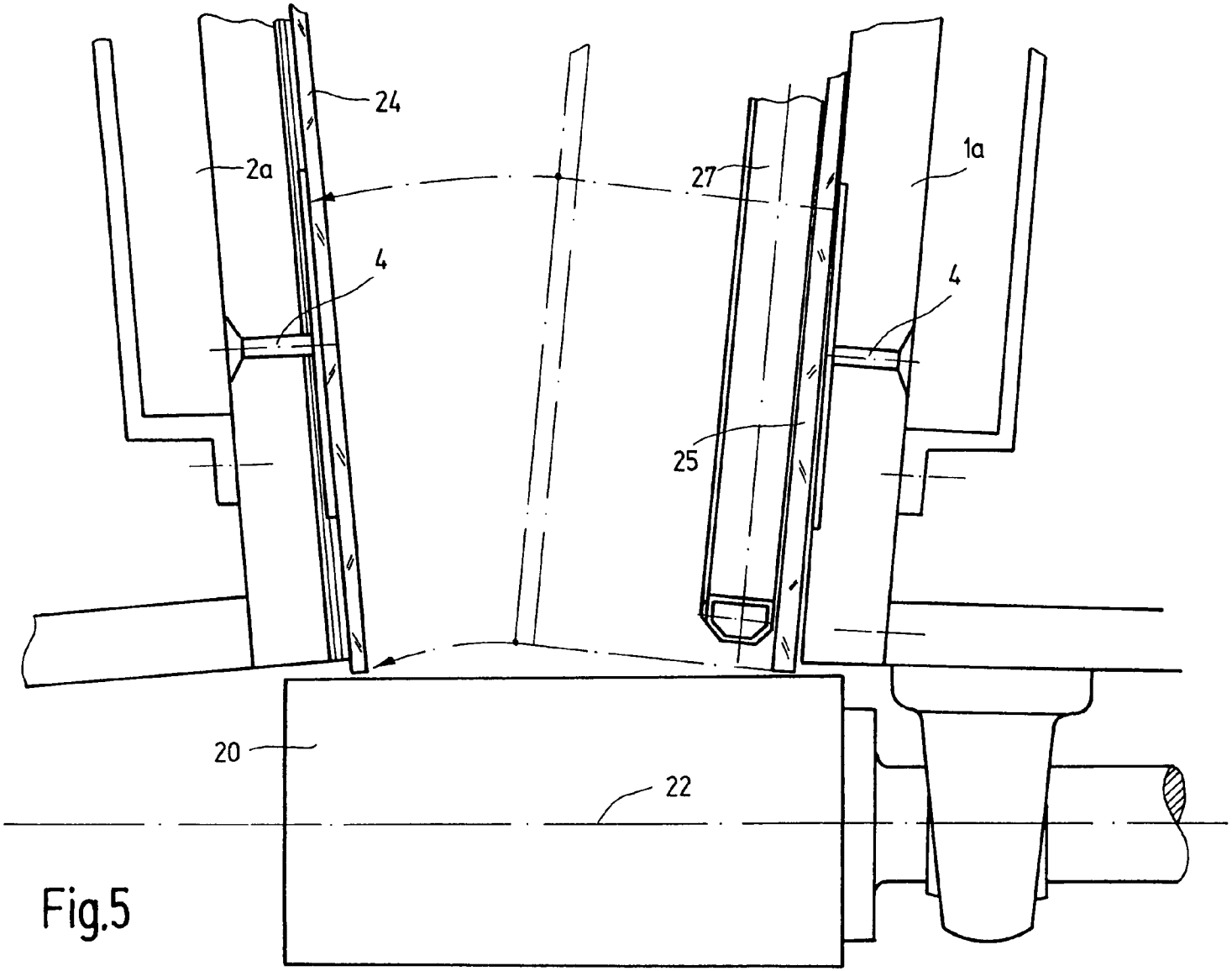
FIG. 5 shows a representation of the pairing station similar to that of FIG. 4, but with the supporting devices arranged in V form, in their initial position.

Now the second movable plate 2*a* of the supporting device 2 is initially pivoted into a parallel position relative to the first plate 1*a*, by activation of the spindle 15*a*, and is then displaced by synchronous activation of all spindles 15 and 15*a* in parallel to itself until it comes to hit against the first glass sheet 24. That motion sequence is illustrated by broken lines in FIG. 3. Thereafter air is extracted from the chamber 6 behind the movable plate 2*a*, whereby the first glass sheet 24 is firmly attached by suction to the plate 2*a* and is fixed on the latter. The spindles 15 and 15*a* are then driven in opposite direction, whereby the plate 2*a* is moved away from the stationary plate 1*a*, in parallel to itself. Due to the angle existing between the rail 12 and the horizontal line 9, the glass sheet 24 is lifted off the horizontal conveyor 20 during this motion at the same angle and is temporarily held in a lifted intermediate position, as illustrated in FIG. 4. Now, a second glass sheet 25, carrying a spacer 27, can be fed into the pairing station along the same track on which the glass sheet 24 had been fed into the pairing station, during which process the position of the first glass sheet 24 will remain unchanged; the second glass sheet is then stopped in the pairing station in the same first position in which the first glass sheet 24 had been stopped before. The two glass sheets 24 and 25 are now arranged in registration one opposite to the other—see FIG. 4. By driving the upper spindles 15*a*, the second movable plate 2*a* is now pivoted back to its initial position illustrated in FIGS. 1 and 3. The position of the pivot axis 10 and the pivoting angle are adjusted for this purpose to ensure that the first glass sheet 24 will not yet contact the horizontal conveyor when the second movable plate 2*a* has again reached its initial position. Once this has occurred, extraction of air from the chamber 6 behind the second movable plate 2*a* is stopped so that the first glass sheet 24 is no longer fixed in its position, but will slide down on the second plate 2*a* until it comes to rest on the horizontal conveyor 22 (see FIG. 5). The length of this sliding movement is, for example, 1 mm to 2 mm, a distance that is absolutely uncritical for the first glass sheet 24.

Figure 6:
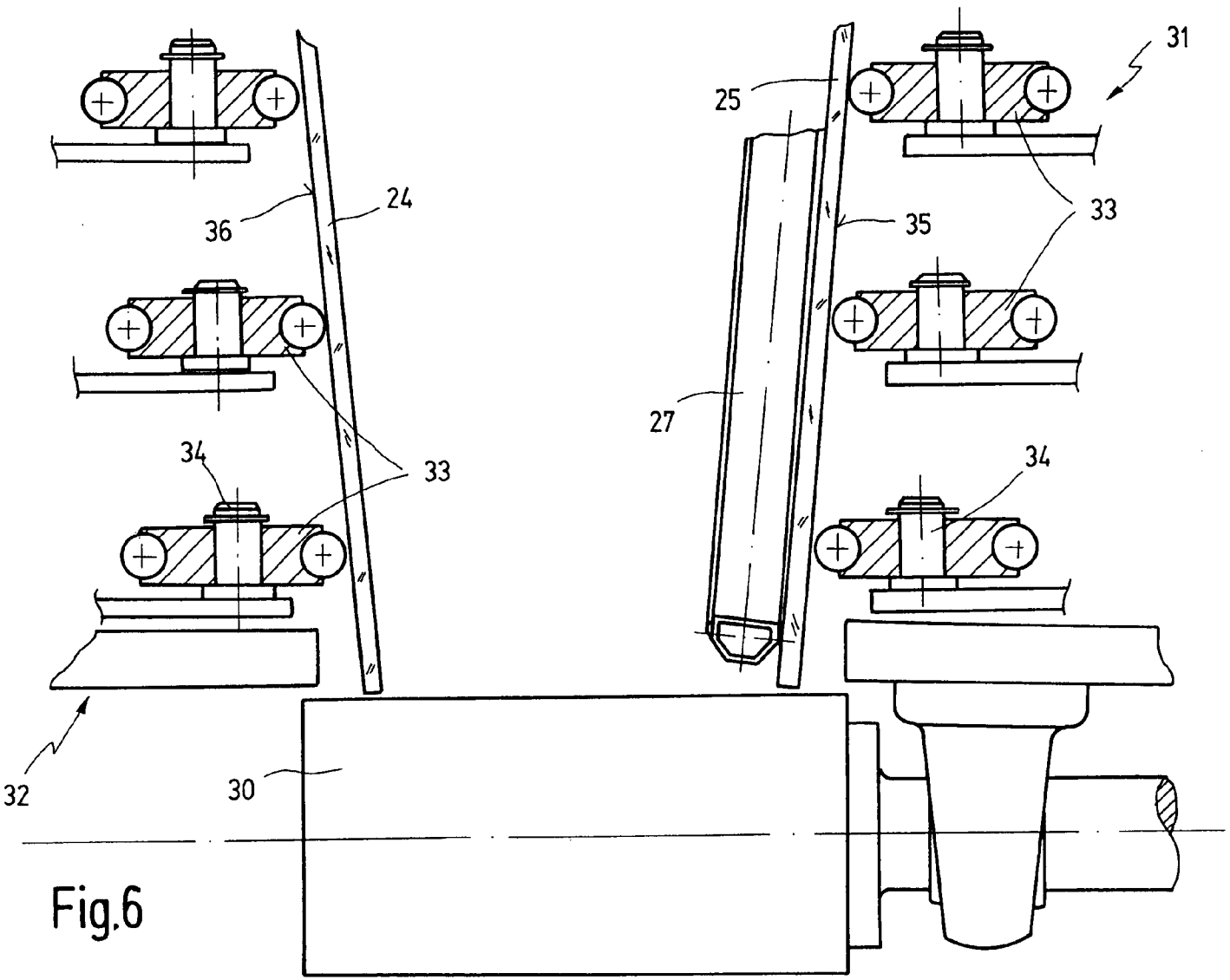
FIG. 6 shows a vertical section through the lower area of a buffer station provided downstream of the pairing station, as illustrated in FIG. 5.

Now, the two glass sheets 24 and 25 are arranged in registration and opposite one to the other in V form, with their outer lower edges resting on the horizontal conveyor 20. This completes the pairing operation for those two glass sheets 24 and 25. The two glass sheets 24 and 25 are now conveyed into a buffer station (see FIG. 8) downstream of the pairing station by activation of the horizontal conveyor 20. A section through part of the lower portion of the buffer station, taken at a right angle to the conveying direction, is shown in FIG. 6. In the illustration of FIG. 6, the conveying direction extends at a right angle to the drawing plane. The buffer station comprises a first supporting device 31 and a second supporting device 32, both of them being equipped with a field of free-wheeling rollers 33 with a vertical axis 34. The rollers 33 of the first supporting device 31 have a common tangential plane 35 and the rollers of the second supporting device 32 have a common tangential plane 36. The tangential planes 35 and 36 are inclined in opposite directions relative to the vertical line. The tangential plane 35 is aligned with the front of the first plate 1*a* in the pairing station. The tangential plane 36 is aligned with the front of the second plate 2*a* in the pairing station when the latter occupies its initial position illustrated in FIGS. 1, 3 and 5. The axes 34 of the rollers 33 are stationary so that the position of the tangential plates 35 and 36 does not change. A further horizontal conveyor 30, whose upper surface is aligned with the upper surface of the horizontal conveyor 20 in the pairing station and which can be configured in the same way as the latter, is arranged below the supporting devices 31 and 32. The horizontal conveyor 30 is a second track of the horizontal conveyor extending through the production line.

It should be noted that alternatively the first supporting device 1 located in the pairing station may be configured identically to the first supporting device 31 in the buffer station.

The horizontal conveyor 30 can be driven independently of the horizontal conveyor 20. By driving the conveyors in synchronism, the glass sheets 24 and 25 (FIG. 5), located one opposite the other in the pairing station, are fed into the buffer station (FIG. 6) and are positioned in that station in a predefined second position with the rear edges of the glass sheets 24 and 25 as close as possible to the rear end of the buffer station, as is illustrated in FIG. 7 for a pair of glass sheets D1/D2, by way of example.

Given the fact that the glass sheets 24 and 25 are inclined in opposite directions, instead of being placed vertically on the horizontal conveyors 20 and 30, they are supported on the respective horizontal conveyor 20, 30 by their outer lower edges. The sharp glass edges lead to good adhesion between the glass sheets 24 and 25 and the normally somewhat resilient surface of the horizontal conveyors 20, 30, which may for example consist of a polyurethane known under the trade name Vulkollan. As a result of the good adhesion effect, slippage between the glass sheets 24 and 25 and the horizontal conveyors can be excluded so that the glass sheets 24 and 25 will not get displaced one relative to the other during the feeding motion, but will retain their relative positions one to the other.

Figures 7, 8, 9, 10:
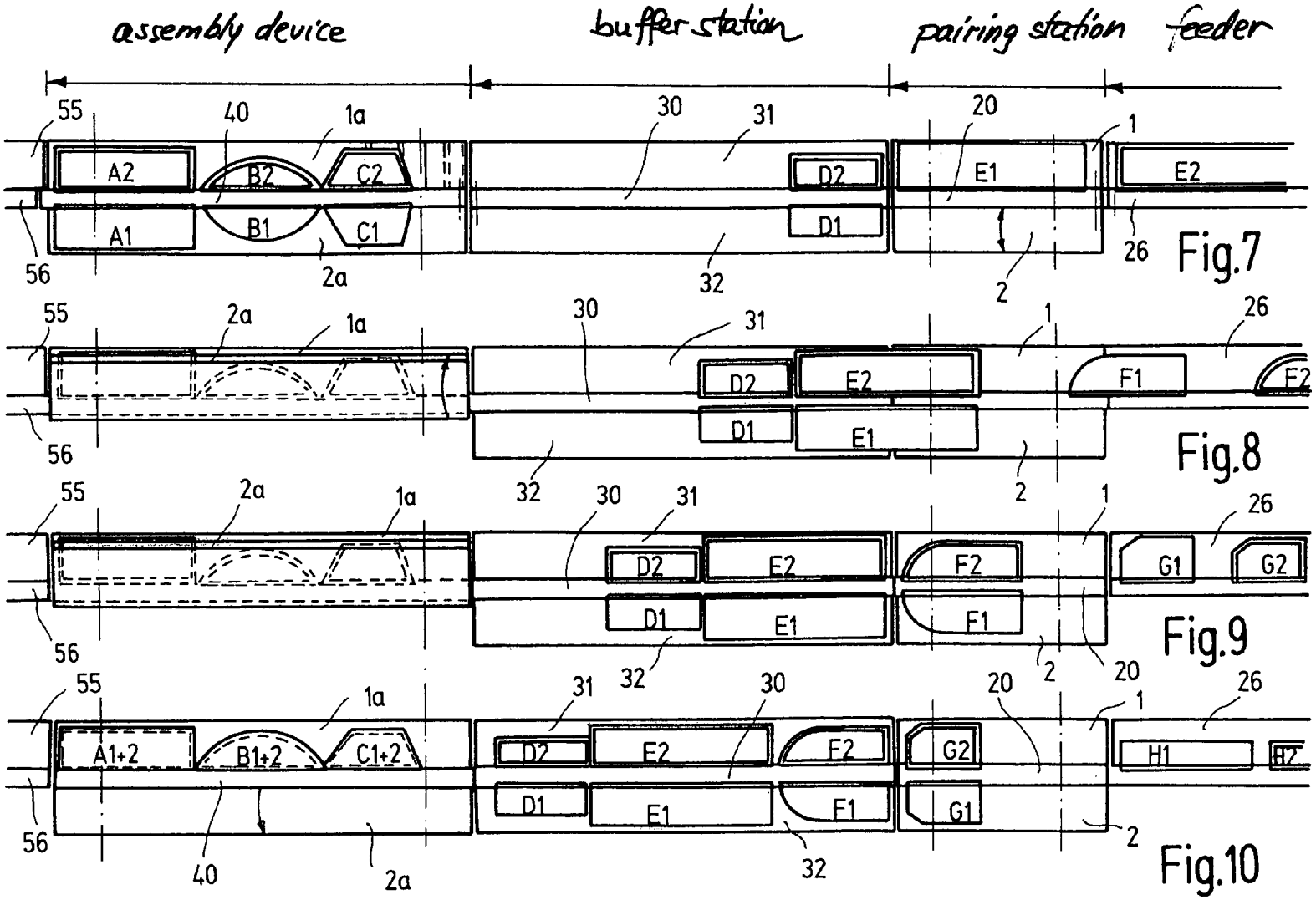
FIGS. 7 to 10 show a diagrammatic top view of a detail of a production line for insulating glass panes, illustrating successive phases of the production of insulating glass panes.

The operations of pairing the glass sheets, i.e. arranging one pair of glass sheets exactly opposite one to the other, and of transferring the glass sheet pair to a buffer station are repeated according to the invention until the buffer station can no longer accommodate any further glass sheet pairs, as is illustrated diagrammatically in FIGS. 7 to 10:

FIG. 7 illustrates a point in time where a glass sheet pair D1/D2 has been positioned at the rear end of the buffer station. As the glass sheet pair D1/D2 is transferred into the buffer station, a next first glass sheet E1 may already be fed into the pairing station and may be positioned on the forward end of the first supporting device 31 by the feeder 26 (FIG. 7), before it is attached by suction to the second supporting device 32 in that position in the described way and transferred to the oppositely inclined position. Once this has been done, the second glass sheet E2, carrying a spacer 27, is then transported into and positioned in the pairing station in registration with and opposite to the glass sheet E1. Now, the glass sheet pair E1/E2 is transferred to the buffer station, while at the same time transportation of the glass sheet pair D1/D2 in the buffer station continues in order to make room for the next following glass sheet pair E1/E2 (see FIG. 8). While this process continues, the next first glass sheet F1 of the next following glass sheet pair F1/F2 may already be fed into the pairing station. In order to reduce the spacing between the glass sheet pair D1/D2 and E1/E2 from the spacing they still have in FIG. 7 to the smaller spacing they still have in the phase illustrated in FIG. 8, the drive of the horizontal conveyor 20 is switched on a little earlier than the drive of the horizontal conveyor 30. The drive of the horizontal conveyor 30 is stopped again when the rear edges of the glass sheet pair E1/E2 have passed the rear end of the buffer station so that the rear edges of the glass sheet pair E1/E2 assume the "second" position which the rear edges of the glass sheet pair D1/D2 occupied in the phase illustrated in FIG. 7—see FIG. 9. The drive of the horizontal conveyor 20 in the pairing station is switched off later when the forward edge of the next following glass sheet F1 has reached the forward end of the pairing station (see FIG. 9). The glass sheet pair F1/F2 is now paired, and once this is accomplished (FIG. 9), the glass sheet pair F1/F2 is transferred into the buffer station in the described way and is positioned in the buffer station in the "second" position in which the rear edges of the glass sheet pair F1/F2 come to lie at the rear end of the buffer station at the point where the rear edges of the glass sheet pair E1/E2 had been positioned before. There is now no room left in the buffer station for the next following glass sheet pair G1/G2. The glass sheet pair G1/G2 can be transferred into the buffer station only when feeding of the glass sheet pairs D1/D2, E1/E2 and F1/F2 into the assembly and pressing device begins. During the phase in which the buffer station was filled with the glass sheet pairs D1/D2, E1/E2 and F1/F2, three preceding glass sheet pairs A1/A2, B1/B2 and C1/C2 have been positioned in the assembly and pressing device downstream of the buffer station for being filled with heavy gas, have been filled with heavy gas and have been closed and pressed to form the final insulating glass panes.

Basically, the structure of the assembly and pressing device resembles the structure of the pairing station so that the description of the structure of the pairing station given with reference to FIGS. 1 to 5 likewise applies to the assembly and pressing device. The systems are different insofar as the assembly and pressing device is longer than the pairing station, namely so long that it is capable of receiving all the glass sheet pairs accommodated in the buffer station. Thus, the buffer station and the assembly and pressing device are adapted in length one to the other. Another difference consists in that the assembly and pressing device is equipped with devices for supplying the heavy gas, with a view to the gas-filling operation, and with sealing means with a view to preventing losses of heavy gas. This will be described hereafter with reference to FIGS. 11 to 18. In view of the largely analogous structure of the pairing station and the assembly and pressing device, corresponding parts are designated by corresponding reference numerals. In view of their task, namely to press the insulating glass panes, the structure of the pressure plates may be stiffer than the structure of the plates la and 2*a* in the pairing station.

Figure 11:
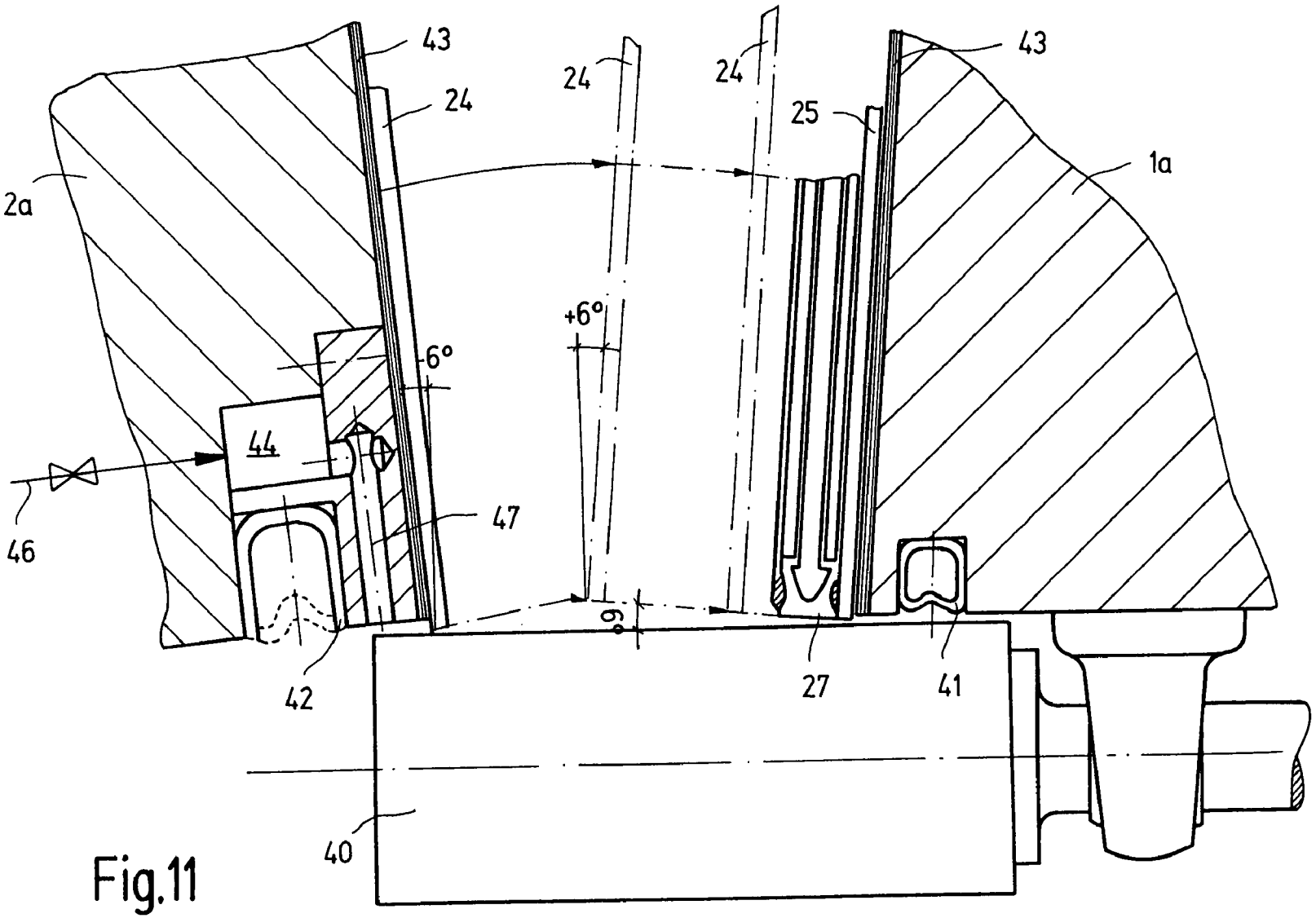
FIG. 11 shows a vertical cross-section, corresponding to FIG. 5, through the lower area of a device for assembling, gas-filling and pressing insulating glass panes, with the pressure plates in their initial position in V form.

The pressure plates 1*a* and 2*a* in the assembly and pressing device, and also the corresponding plates 1*a* and 2*a* in the pairing station are provided with holes through which air can be selectively blown to produce an air cushion on which the glass sheets can slide while being transported, or extracted in order to fix the glass sheets on the plates. These openings are not shown in FIGS. 11 to 18 for reasons of clarity. The sides of the pressure plates 1*a* and 2*a* that face each other are provided with a layer 43 of rubber or another elastomeric material. The layer may have a thickness of 3 mm to 4 mm, for example. In the pressure plates 1*a* and 2*a*, which are aligned with the stationary plate 1*a* of the pairing station or with the movable plate 2*a* of the pairing station in their initial positions, a hose 41 or 42, respectively, is provided in a longitudinal groove arranged in the lower edge of the pressure plates 1*a* and 2*a*, which hose can be selectively evacuated or blown up. In the evacuated condition, it has no contact with the horizontal conveyor 40, as is illustrated in FIG. 11. The horizontal conveyor 40 in the assembly and pressing device comprises a conveyor element in the form of a belt 40*a*, especially a toothed belt, which closes the gap between the two glass sheets 24 and 25 and which also seals the space between the belt 40*a* and the hoses 41 and 42 in the two pressure plates 1*a* and 2*a*. The hose 42 extends substantially over the full length of the pressure plates 1*a* and 2*a*. As will be explained hereafter, the hose 41 may be subdivided into separate sections.

Figure 12:
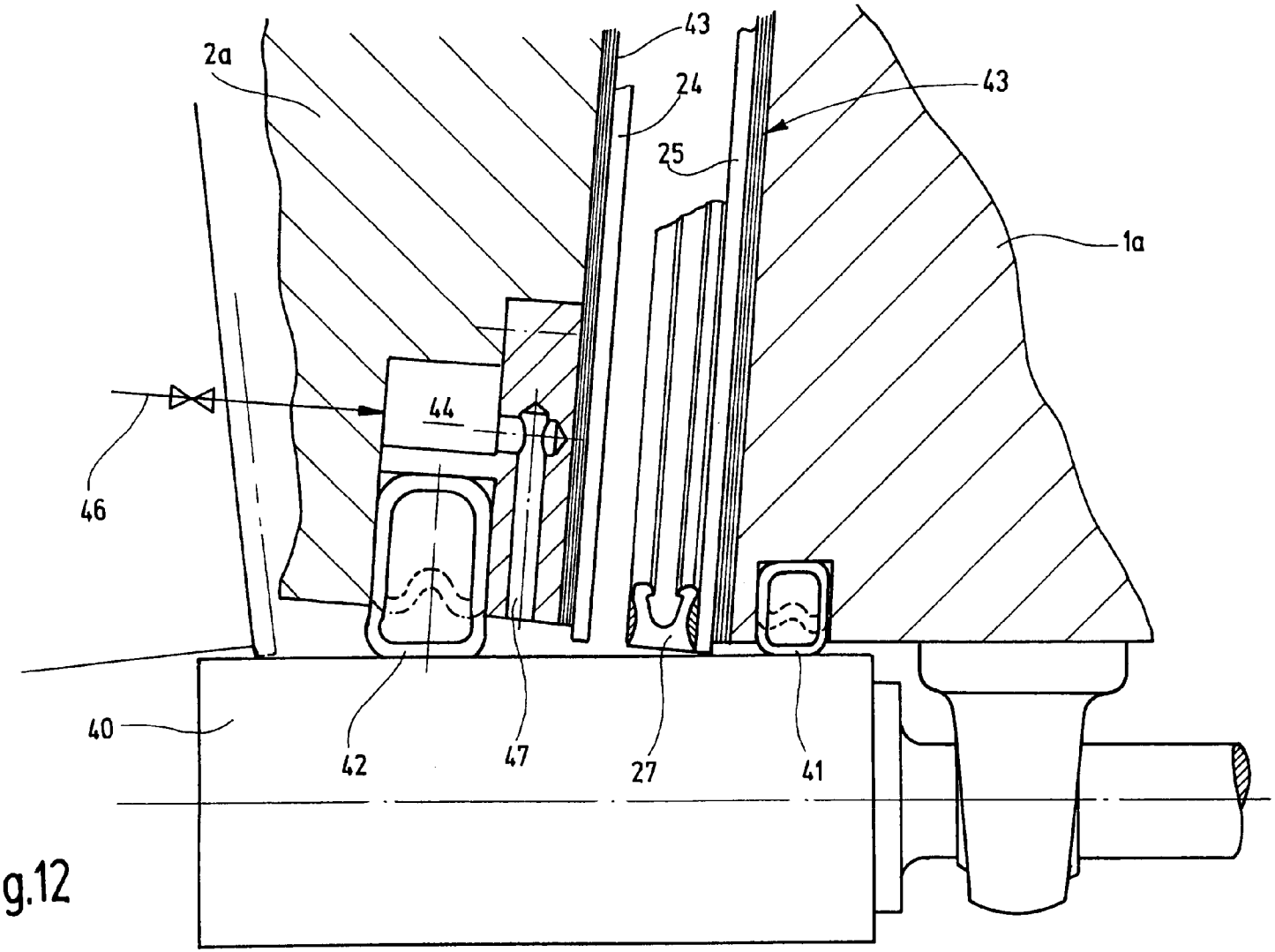
FIG. 12 shows a section, corresponding to FIG. 11, through the device for assembling, gas-filling and pressing insulating glass panes, but with the pressure plates standing upright one parallel to the other, with the insulating glass panes not yet closed, in the gas-filling phase.

A horizontal channel 44, arranged behind the hose 42, is subdivided into separate sections by partition walls 45—see FIG. 12. The sections of the channel 44 can be supplied with a gas different from air through supply lines 46 that can be shut off separately. At least one branch duct 47, preferably a longitudinal slot, or a series of branch ducts lead from each section of the channel 44 in downward direction, ending at the lower edge of the movable pressure plate 2*a* in the area between the hose 42 and the rubber layer 43—see FIG. 11.

Figure 13:
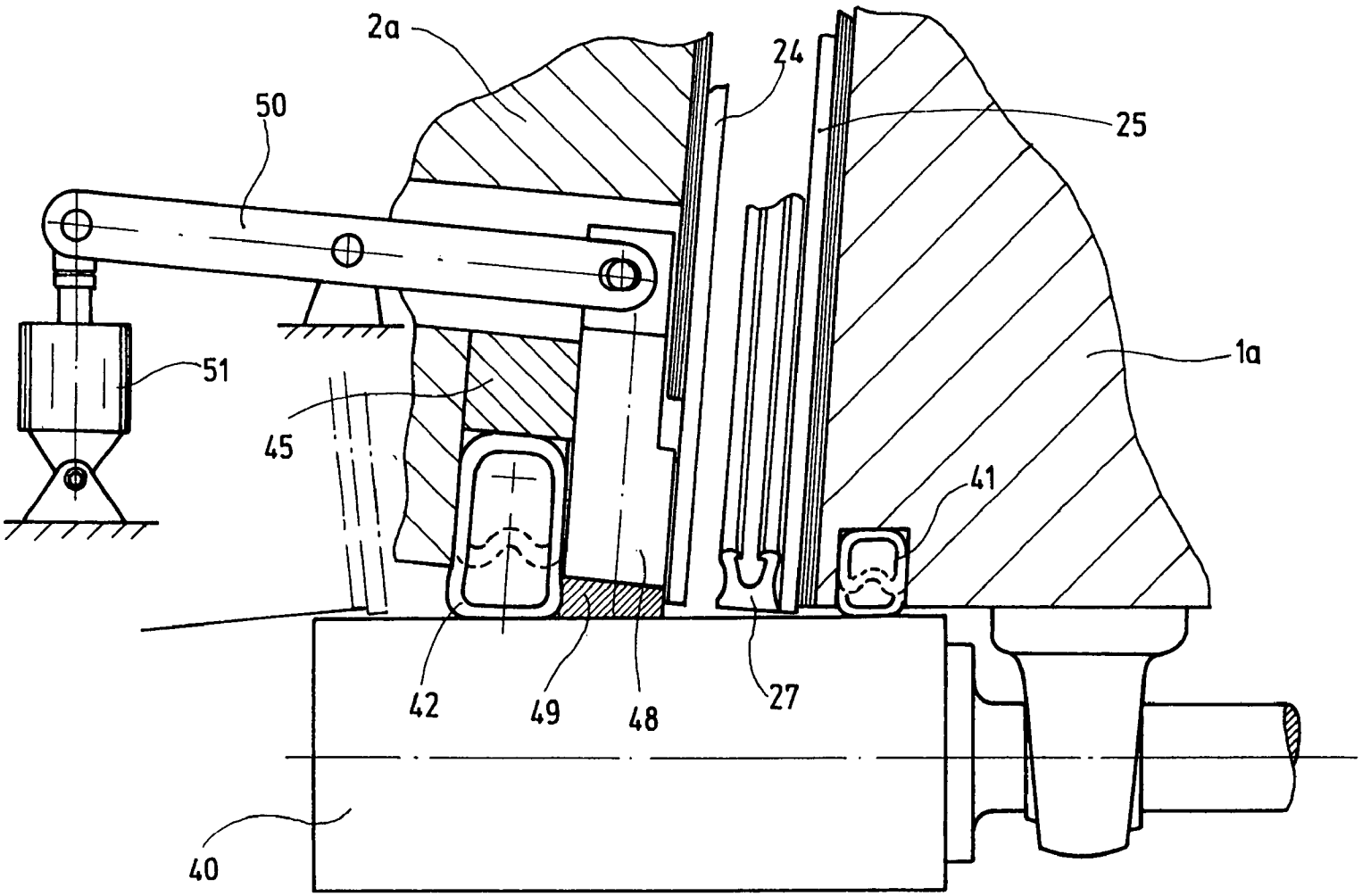
FIG. 13 shows a vertical section through the lower area of the device for assembling, gas-filling and pressing insulating glass panes, illustrating the same phase as FIG. 12, but taken through a partition wall of the heavy gas supply channel.
Figure 14:
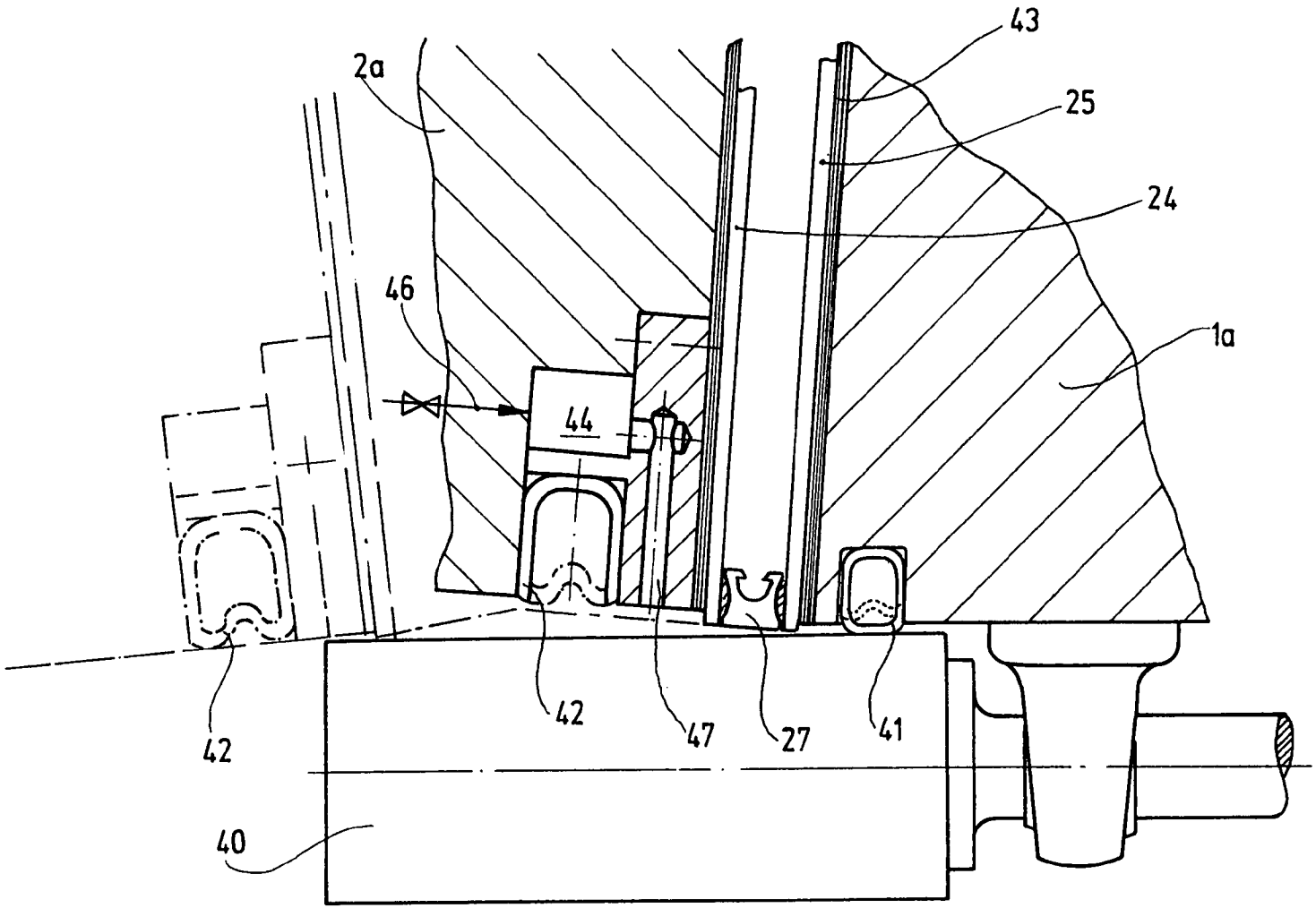
FIG. 14 shows a view, corresponding to FIG. 12, of the assembly, filling and pressing device, in the phase of the pressing operation.

Slides 48 provided at each point where the channel 44 is subdivided by partition walls 45—see FIG. 13—end flush with the surface of the rubber layer 43 and carry at their lower ends, facing the belt 40*a*, a layer 49 made from a resilient material. The slide 48 can be opened and closed by means of a two-armed lever 50 engaged by a pneumatic cylinder.

Sealing strips 52 provided opposite the slides 58 and extending from the top to the bottom in the stationary pressure plate 1*a* can be advanced toward the movable pressure plate 2*a* and its slide 48. To this end, the hose 41 may be subdivided into separate sections so that the sealing strip 52 can be pushed forward through a gap between two sections of the hose 41 which is then closed by the sealing strip 52. According to another possibility where the hose 41 may be uninterrupted over the full length of the pressure plate 1*a*, the selected configuration may be such that the drive for advancing the sealing strips 52 is designed in such a way that the strips can be moved against the movable pressure plate 2*a*, passing above the hose 41, and can then be lowered onto the belt 40*a*. According to a further possibility, the belt 40*a* can be supported on a rail which projects beyond the belt 40*a* below the stationary pressure plate 1*a* a sufficient length to permit a hose, extending over the full length of the stationary pressure plate 1*a*, to be fitted in a longitudinal groove extending adjacent the belt 40*a*. If the hose is then blown up, it applies itself to the bottom of the stationary pressure plate 1*a* in sealing relationship. When the hose 42 is blown up, it applies itself to the belt 40*a* in sealing relationship (FIG. 12).

Figure 19:
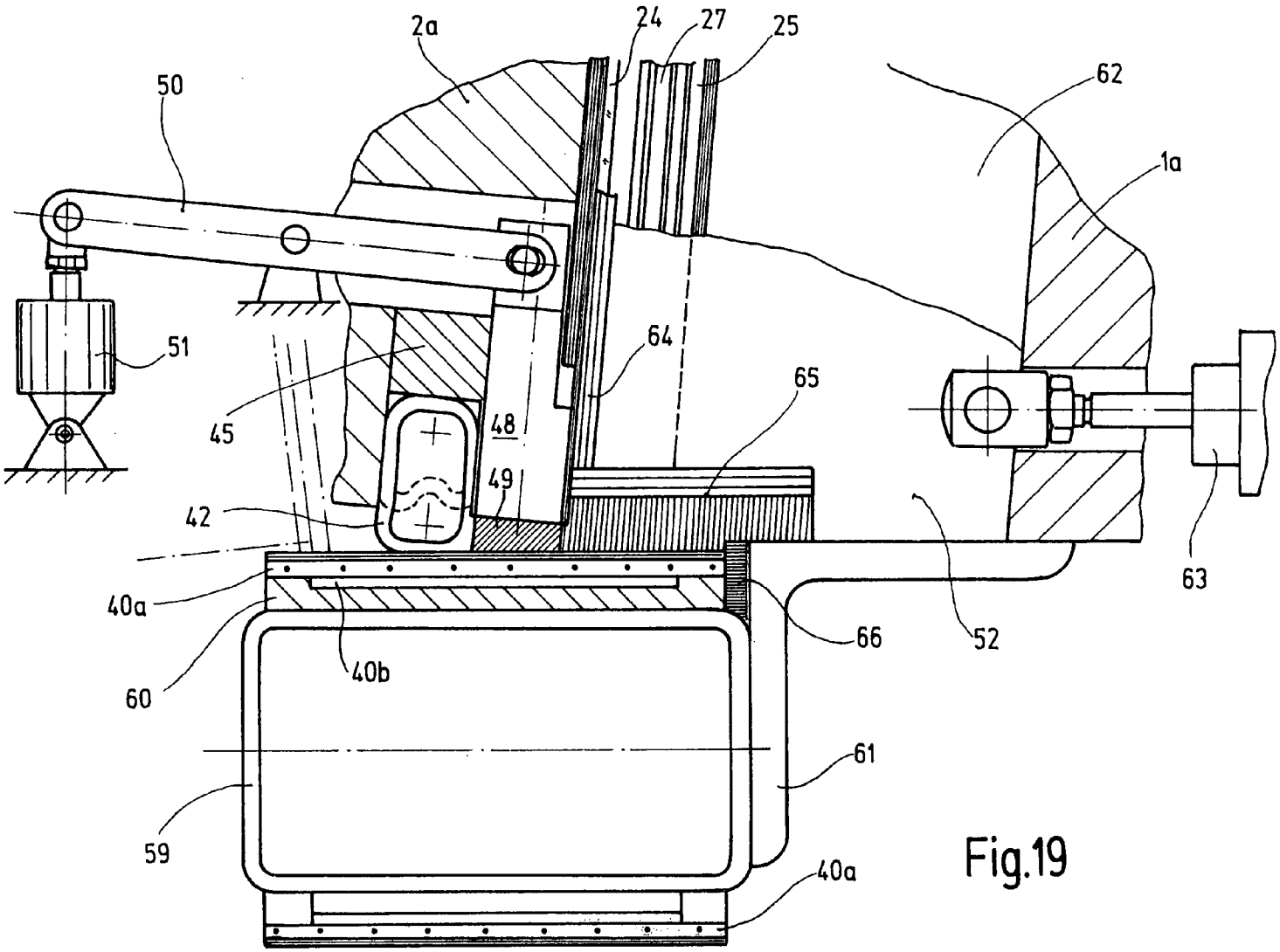
FIG. 19 shows a view, similar to FIG. 13, of a detail of an assembly, filling and pressing device with a modified sealing concept.

Another possibility to achieve a sealing effect between the stationary pressure plate 1*a* and the belt 40*a* is illustrated in FIG. 19. The belt 40*a* is a toothed belt whose teeth 40*b* do not extend over the full width of the bottom surface of the belt 40*a* and run in a recess in a flat rail 59 mounted on an elongated carrier 16 in the form of a hollow section. The carrier 60 is fixed on the bottom surface of the immovable pressure plate 1*a* by an L strap 61. The carrier 60 and the L strap 61 extend over the full length of the pressure plate 1*a*. Accordingly, no heavy gas can escape transversely to the conveying direction of the belt 40*a* below the stationary pressure plate 1*a*.

FIG. 19 further illustrates a possible configuration and arrangement of the sealing strip 52. The strip is positioned opposite the slide 48 in a vertical slot 62 in the stationary pressure plate in which in can be advanced and retracted by means of two pneumatic cylinders 63. One of the pneumatic cylinders 63 is illustrated in FIG. 19 and is located at the lower end of the sealing strip 52. A second pneumatic cylinder is correspondingly arranged at the upper end of the sealing strip, which is not shown in FIG. 19. At the forward edge of the sealing strip, there is provided a rubber strip 64 by which the sealing strip 52 hits against the oppositely arranged movable pressure plate 2*a* as it is advanced. At the lower end of the sealing strip 52, there is provided a recess that opens toward the oppositely arranged pressure plate 2*a* and in which a brush 65 is fitted whose bristles contact the L strap 61 and the upper run of the belt 40*a*. A further brush 66 is mounted on the L strap over its full length to fill a gap between the L strap on the one side and the belt 40*a* and the rail 59, the bristles extending from the L strap 61 to the opposite lateral surface of the belt 40*a* and the rail 59. The bristles 65 and 66 prevent any outflow of heavy gas in the conveying direction or against the conveying direction. For the rest, the structure of the embodiment illustrated in FIG. 19 corresponds to that illustrated in FIG. 13.

Together with the slide 48, upon which the sealing strip 52 hits in the advanced position, the strip acts to laterally seal the space in which the insulating glass panes are located in their non-assembled condition, and prevents any heavy gas from flowing in a transverse direction, out of the area of the insulating glass panes, during introduction of heavy gas. A heavy gas commonly used for purposes of the invention is Argon.

Figure 15:
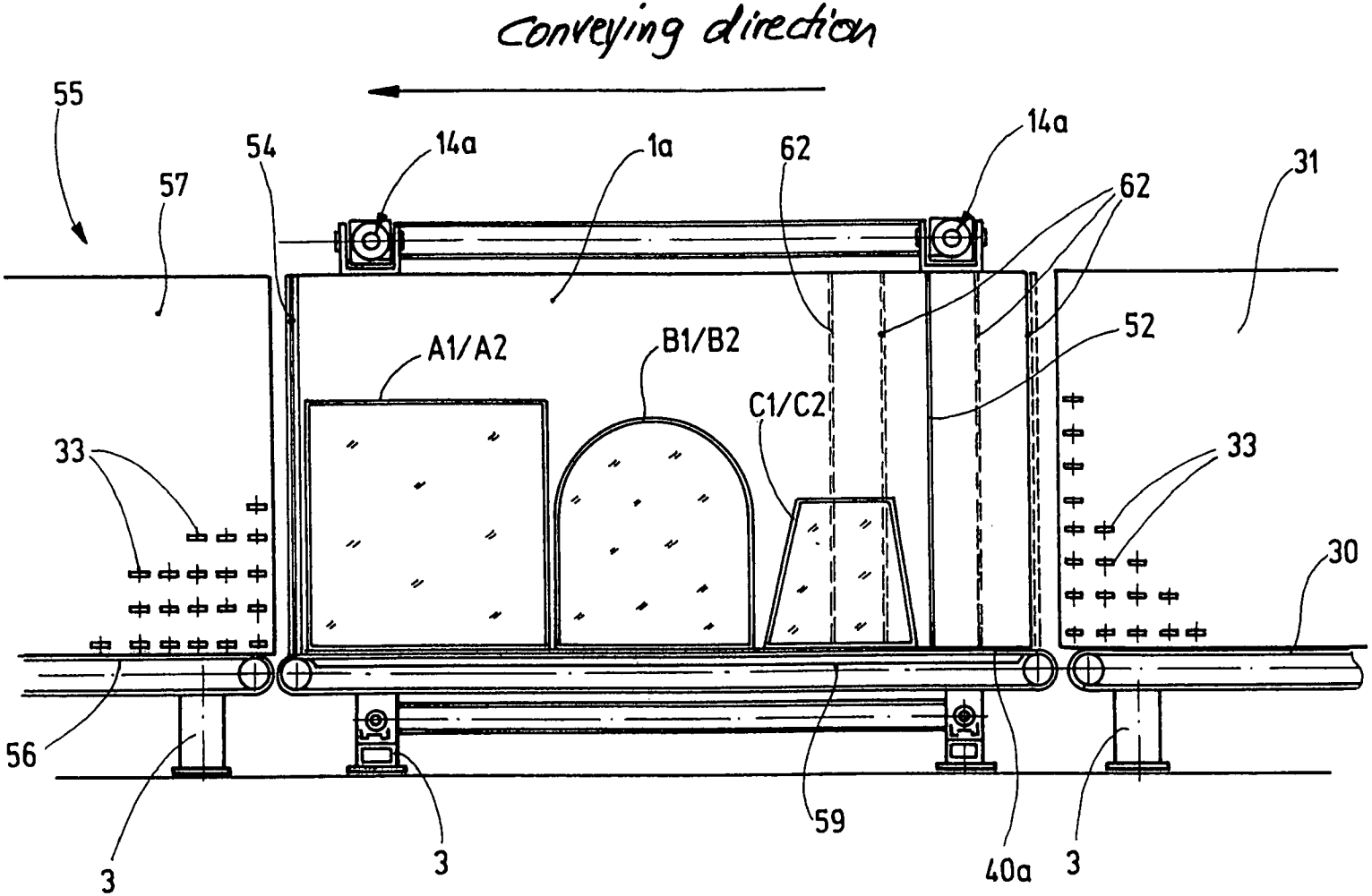
FIG. 15 shows a longitudinal section through the assembly, filling and pressing device according to FIG. 12, taken along line XV-XV in FIG. 12, before commencement of the gas-filling operation.

FIG. 15 shows that some such sealing strips 52 may be arranged in the rear area of the pressure plate 1*a*, whereas another sealing strip 54, that can be pivoted by means of a pneumatically operated four-bar linkage 58, can be pivoted against the vertical edges of the two pressure plates 1*a* and 2*a* in order to achieve a sealing effect relative to the pressure plates 1*a* and 1*b* and to the belt 40*a* so that the heavy gas is prevented from flowing out during the filling operation also at the forward end of the assembly and pressing device.

Figure 18:
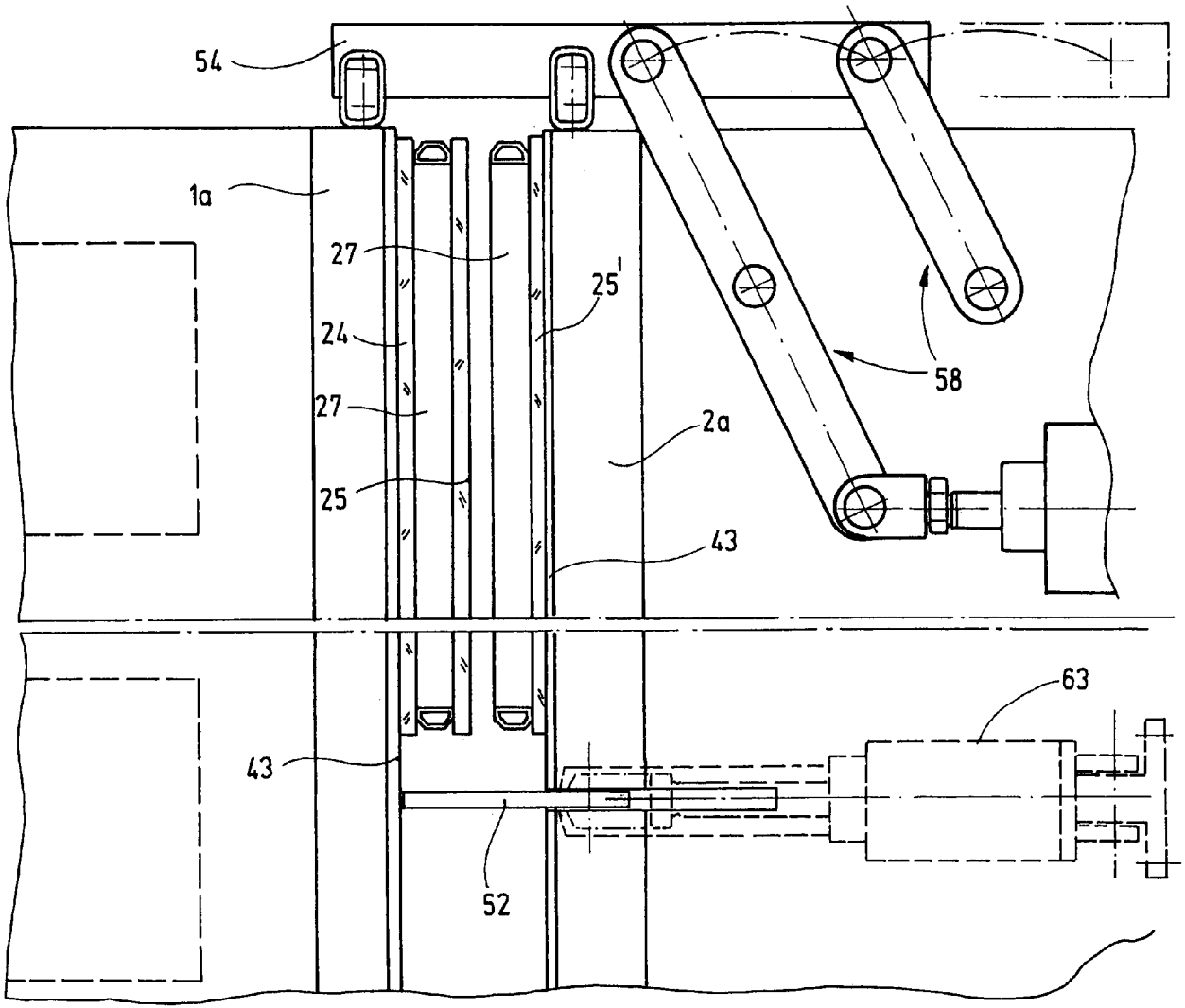
FIG. 18 shows a section, taken along line XVIII-XVIII perpendicularly to one of the pressure plates, illustrating a detail of the area of a seal arranged between the ends of the pressure plates and a further seal arranged at the front end of the pressure plates.

The assembly and pressing device for insulating glass panes operates as follows:

Glass sheet pairs, that have been placed in the buffer station, for example the glass sheet pairs A1/A2, B1/B2 and C1/C2, are conveyed into the assembly and pressing device by synchronous operation of the horizontal conveyors 30 and 40 and are positioned in the device in such a way that the forward edges of the leading glass sheets A1/A2 come to be located at the forward edge of the pressure plates 1*a* and 2*a*. At that time, the pressure plate 2*a* is still in its initial position illustrated in FIG. 11. As has been described before in connection with the pairing station, the movable pressure plate 2*a* now is at first pivoted into an intermediate position closer to the first pressure plate 1*a* and parallel to it. The first glass sheet 24 is lifted off the belt 40*a* by that operation. After having been pivoted into the parallel position, the movable pressure plate 2*a* is further approached to the stationary pressure plate 1*a*, in parallel to itself, until a second intermediate position is reached in which a gap remaining between the first glass sheet 24 and the spacer 27 has a width of only a few millimeters; suited for this purpose is a gap width of 2 mm to 6 mm, for example. The two intermediate positions of the first glass sheet 24 are illustrated by broken lines in FIG. 11. FIG. 12 shows the second intermediate position of the movable pressure plate 2*a*. In this second intermediate position, the gas can be introduced. To this end, the sealing strip 54 (see FIG. 18) is initially applied to the forward edge of the two pressure plates 1*a* and 2*a* and is placed on the belt 40*a* in order to seal the device in that area. In the rear area of the assembly and pressing device, the sealing strip 52, which is the closest to the rear edge of the rear glass sheet pair C1/C2, is pushed out of the stationary pressure plate 1*a* to effect sealing in that area (FIG. 18). Further, the slide 48, opposite the sealing strip 52 to be displaced, is pushed down against the belt 40*a* to seal the gap between the belt 40*a* and the lower edge of the movable pressure plate 2*a* (see FIG. 13). This prevents any heavy gas, supplied via the channel 44 and the branch ducts 47, from escaping against the conveying direction. As a result of the filling process, the heavy gas rises between the glass sheet pairs A1/A2, B1/B2 and C1/C2—see FIG. 16. Due to the inclined position of the glass sheets 24 and 25 on the belt 40*a*, the gap between the first glass sheet 24 and the belt 40*a* has a width of between approximately 2 mm to approximately 5 mm, depending on the thickness of the insulating glass pane to be produced, which is fully sufficient to allow almost pressureless introduction of the gas into the space between the glass sheets 24 and 25 so that the lighter air will be displaced to the top without greater turbulences, over the full length of the glass sheet pairs, and a high filling degree of the heavy gas will be quickly reached with only little losses of heavy gas. The heavy gas need not rise up to the upper edge of the highest glass sheet pair A1/A2; instead, the supply of heavy gas may be stopped already when a lower level 53 is reached, as illustrated in FIG. 6, because the insulating glass panes still have to be closed and pressed by moving the movable pressure plate 2*a* against the stationary pressure plate 1*a*—see FIG. 14—and the heavy gas present between the glass sheet pairs will be further displaced to the top by that closing movement, so that the insulating glass panes will be filled with heavy gas in full or almost in full. The volume of gas to be displaced during closing of the insulating glass panes can be easily determined by calculation and can be taken into account when determining the amount of heavy gas to be supplied.

Figure 16:
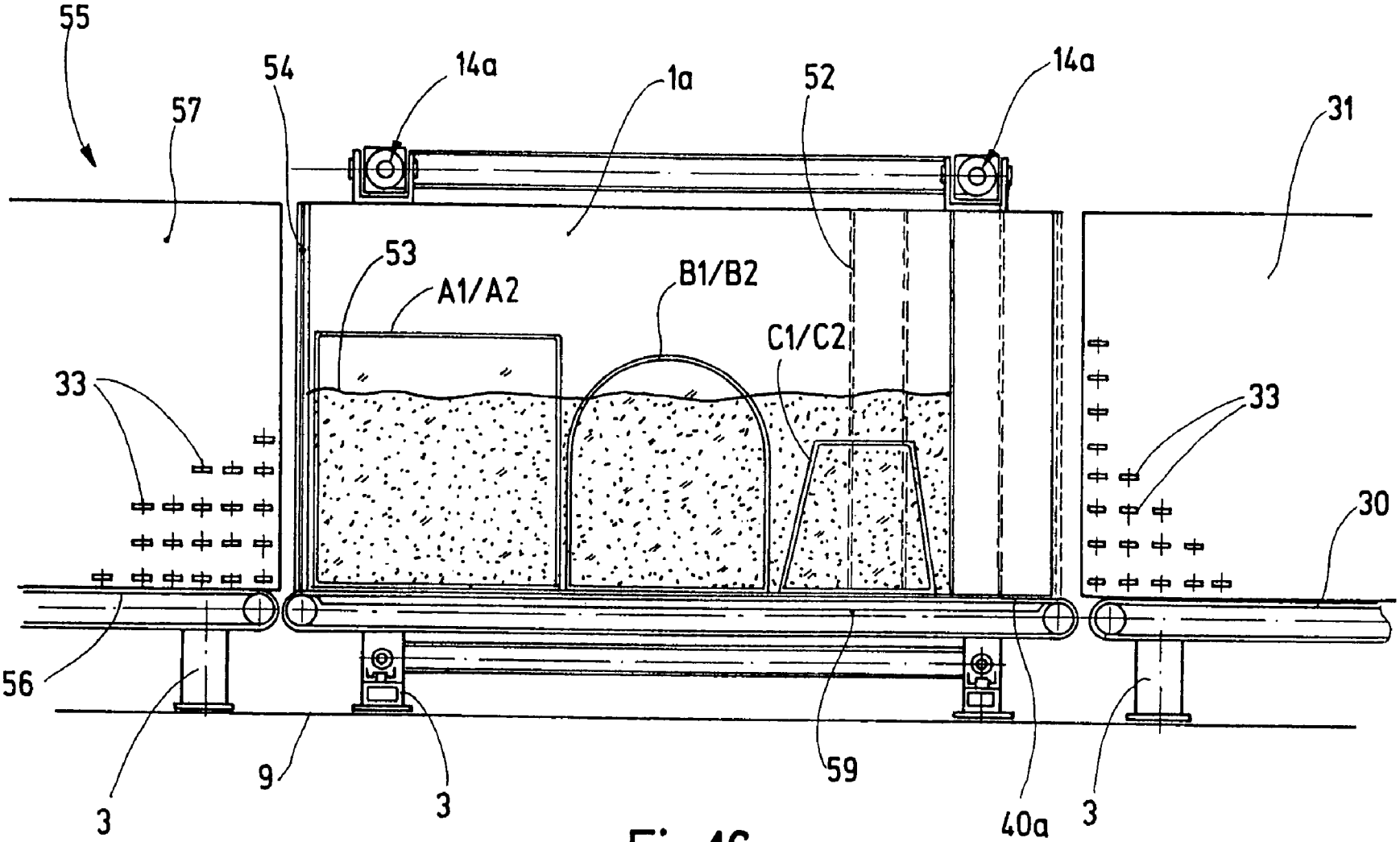
FIG. 16 shows a section corresponding to FIG. 15, illustrating a later phase of the gas-filling operation.
Figure 17:
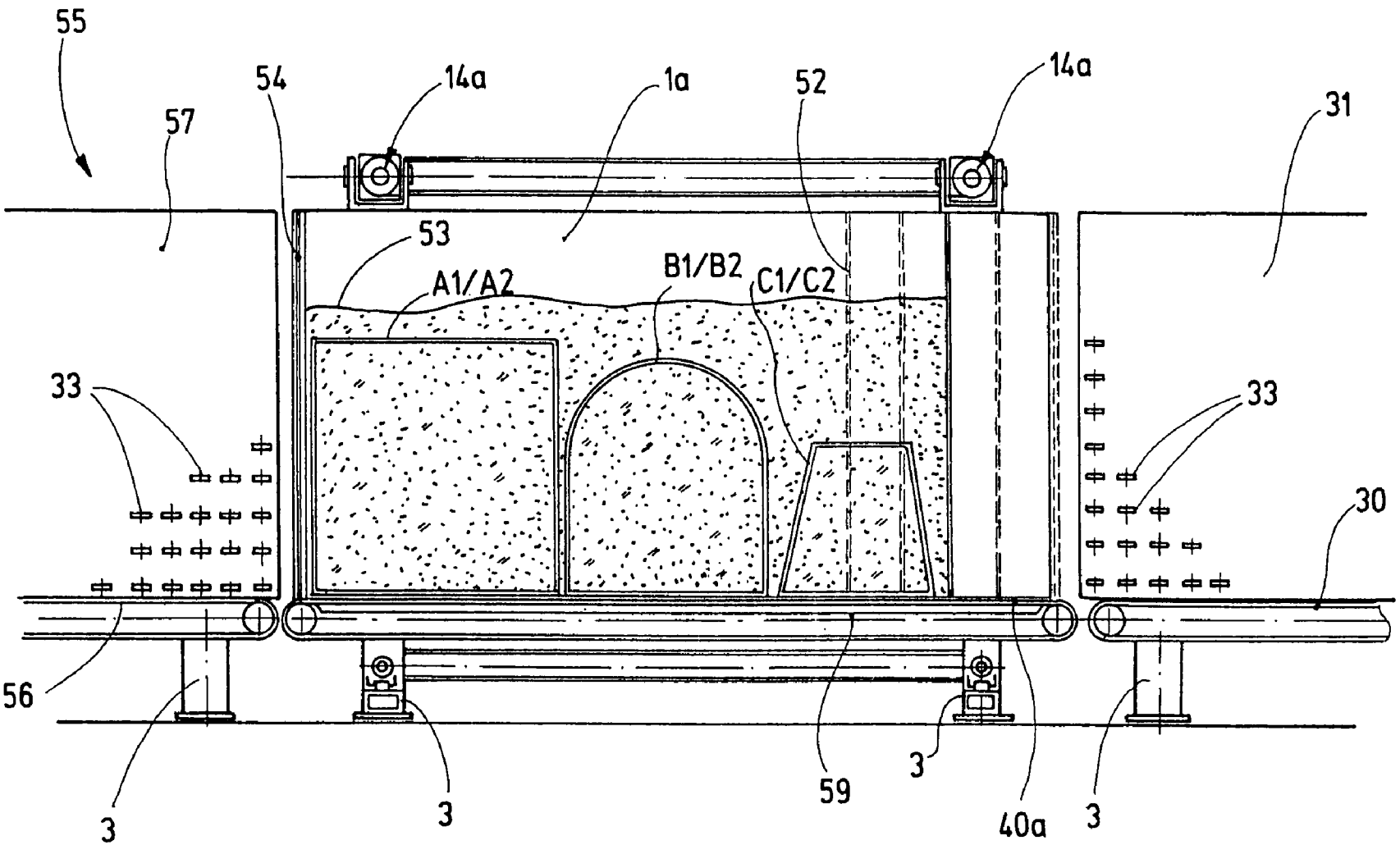
FIG. 17 shows a section, corresponding to FIG. 15, illustrating the end of the gas-filling operation, after the insulating glass panes have been closed, where the pressure plates have assumed the position illustrated in FIG. 14.

During closing of the insulating glass panes, the sealing strip 52 is initially urged back into the stationary pressure plate 1*a* by a corresponding amount and, once the insulating glass panes have been closed and pressed, is then fully retracted into the stationary pressure plate 1*a*. As the insulating glass panes are closed, the level 53 of the heavy gas rises above the upper edge of the highest insulating glass pane A1/A2, as illustrated in FIG. 17. After the insulating glass panes have been closed and pressed, they are transported, by operation of the horizontal conveyor 40, out of the assembly and pressing device and onto a discharge conveyor 55—see FIGS. 10 and 17—which comprises a horizontal conveyor 56 aligned flush with the horizontal conveyor 40 and a supporting device 57, which is aligned with the stationary pressure plate 1*a* and which, though it may consist of an air-cushion wall, preferably is configured in the same way as the supporting devices 31 and 32 in the buffer station—as illustrated in FIG. 16—and, correspondingly, comprises a field of free-wheeling rollers 33.

In order to keep possible losses of heavy gas as small as possible, it is recommended to take care in planning the production process that the order in which the insulating glass panes are assembled is selected to ensure that the insulating glass panes assembled as one lot differ in height as little as possible.

Once the assembled insulating glass panes A1/A2, B1/B2, C1/C2 leave the assembly and pressing device, the next following glass sheet pairs D1/D2, E1/E2, F1/F2 can be fed into the assembly and pressing device as one lot—see FIG. 10.

Given the fact that instead of being placed on the belt 40*a* in vertical arrangement, the glass sheets are inclined in the assembly and pressing device so that they act on the belt 40*a* only by their lower edges, they can be transported free from slippage so that their exact alignment will not get lost. Further, they can be filled with heavy gas from below over their full length without any need to provide a permeable belt which is drawn over the gas-filling channel, or to provide two spaced belts in the horizontal conveyor between which heavy gas can be introduced between the glass sheets—an advantageous solution which has not been known in the art. Instead, it is possible according to the invention to use a conveying element consisting of a uniform, absolutely tight belt 40*a* because the heavy gas can be introduced without any problems from the side of the movable pressure plate 2*a* through a gap between the belt 40 and one of the glass sheets 24. This permits a much simpler structure of the assembly and pressing device with gas-filling system, than has been possible before, and, as two or more than two insulating glass panes are filled with heavy gas simultaneously, also allows short cycle times and cheaper production of insulating glass panes than has been known before, and this especially when producing insulating glass panes of common standard dimensions. On the other hand, the invention can be used for many different applications, not only for the production of rectangular insulating glass panes, but also for the production of what is known as model panes, with a contour different from a rectangular shape. Corresponding examples are illustrated in FIGS. 7 to 10 and 15 to 17. Moreover, three-sheet insulating glass panes can be produced as well. In this case, one initially assembles two glass sheets filled with gas—as described before—and then transports the third glass sheets, that have been positioned in a row in the buffer station before, into the assembly and pressing device for assembling them with the first and second glass sheets, and for filling them with gas, as illustrated in FIG. 18.

Further, large format insulating glass panes of a size that permits only a single one of such panes to be placed in the assembly and pressing device, can produced in the same way as in a conventional production line for insulating glass panes. In this case, the process may include the steps of transporting the two glass sheets, leaning against the immovable supporting devices, one after the other through the pairing station and through the buffer station and into the assembly and pressing device, and of arranging them in opposite pairs only at that point by causing the movable pressure plate 2*a* to attract that glass sheet, which arrives first, by suction and to thereby take over the sheet and make room for delivery of the second glass sheet that carries the spacer.

In all these cases, the heavy gas is permitted to rise in a constant upward flow, without greater turbulences, between parallel glass sheets, and to displace the lighter weight to the top without getting mixed with it.

Finally, it is also possible to assemble insulating glass panes without filling them with a heavy gas.

LIST OF REFERENCE NUMERALS

1. Supporting device
1*a*. Plate
2. Supporting device
2*a*. Plate
3. Frame
4. Holes
5. Hood
6. Chamber
7. Base
8. Struts
9. Horizontal line
10. Axis
11. Carriage
12. Rails
13. Motor
13*a*. Motor
14. Spindle drive
14*a*. Spindle drive
15. Spindle
15*a*. Spindle
16. Housing
16*a*. Housing
17. Holder
17*a*. Holder
18. Holder
20. Horizontal conveyor, first track
20*a*. Belt
21. Motor
22. Axes
23. Gap
24. Glass sheet
25. Glass sheet
26. Feeder
27. Spacer
30. Horizontal conveyor, second track
31. Supporting device
32. Supporting device
33. Rollers
34. Axis
35. Tangential plane
36. Tangential plane
40. Horizontal conveyor, third track
40*a*. Belt
40*b*. Teeth
41. Hose
42. Hose
43. Rubber layer
44. Channel
45. Partition walls
46. Supply line
47. Branch duct
48. Slide
49. Layer made from a sealing material
50. Lever
51. Pneumatic cylinder
52. Sealing strip
53. Level
54. Sealing strip

55. Discharge conveyor
56. Horizontal conveyor
57. Supporting device
58. Four-bar linkage
59. Rail
60. Carrier
61. L strap
62. Slot
63. Pneumatic cylinder
64. Rubber strip
65. Brush
66. Brush

The invention claimed is:

1. Method for assembling insulating glass panes that are filled with a gas different from air, by arranging a first glass sheet and a second glass sheet, provided with a spacer, in a vertical or inclined position so that they are positioned one opposite to the other, to form a glass sheet arrangement having a bottom edge and two upright edges, without the first glass sheet being in contact with the spacer, forming a chamber that encloses a space between the glass sheets, by providing a belt at the bottom edge of the glass sheet arrangement and at least one seal beside each of the upright edges of the glass sheet arrangement, which seal extends from a point above the belt down to the belt, introducing a gas different from air into the chamber from below and closing the insulating glass pane by approaching the glass sheets one to the other once a desired filling grade or filling level has been reached, wherein one of the two glass sheets is held at a spacing from the belt during introduction of the gas different from air and that the gas different from air is introduced into the chamber through a gap between the belt and a lower edge of said one glass sheet while the latter is kept in spaced arrangement.

2. The method as defined in claim 1, wherein the belt has an upper run and is used as a conveying element of a horizontal conveyor.

3. The method as defined in claim 2, wherein the method is carried out between two plates, which can be varied with respect to their spacing one from the other, in a vertical gas-filling and assembly device for insulating glass panes, where the horizontal conveyor, using the belt as a conveyor element, is arranged in the neighborhood of lower edges of the plates, that the glass sheets are conveyed into a space between the plates, standing on the belt in an upright position and leaning against one of the plates, that the glass sheets are arranged one opposite the other between the two plates, that the chamber is delimited by the glass sheets, the plates, the belt and at least two movable seals, which latter are spaced one from the other in the conveying direction, by providing at least one of the seals in front of the glass sheet arrangement and at least one of the seals behind the glass sheet arrangement, and that a gap is formed between the belt and the lower edge of one of the two glass sheets before the gas different from air is supplied.

4. The method as defined in claim 3, wherein the spacing between the lower edge of said one glass sheet and the belt is formed by lifting said glass sheet off the belt.

5. The method as defined in claim 1, wherein the spacing between the lower edge of said one glass sheet and the belt is formed by pivoting the belt away from the lower edge of said one glass sheet.

6. The method as defined in claim 1, wherein the glass sheets are arranged in registration and one opposite the other.

7. The method as defined in claim 1, wherein the glass sheets are arranged in parallel one to the other before the gas different from air is supplied.

8. The method as defined in claim 1, wherein the first glass sheet is lifted off the belt.

9. The method as defined in claim 3 wherein both glass sheets are in surface contact with the plates.

10. The method as defined in claim 3, wherein the gas different from air is supplied through that plate on which the first glass sheet is positioned.

11. The method as defined in claim 10, wherein the gas exits through the bottom of that plate.

12. The method as defined in claim 10 wherein the spacer is initially attached to the second glass sheet.

13. The method as defined in claim 3 wherein only one of the plates is movable and the gas different from air is supplied through the movable plate.

14. The method as defined in claim 3, wherein the plates are arranged in inclined position relative to the belt.

15. The method as defined in claim 14, wherein the upper run of the belt is provided in horizontal arrangement transverse to the conveying direction.

16. The method as defined in claim 3, wherein for arranging the glass sheets between the plates, the upper run of the belt is initially positioned at a right angle or nearly at a right angle relative to the two plates, and is then pivoted, before the gas different from air is supplied, at an acute angle in downward direction about an axis extending in parallel to the conveying direction.

17. The method as defined in claim 3, wherein the plates are initially arranged in V form, whereafter the first and the second glass sheet are conveyed into the space between the plates in V arrangement, and are positioned in V form and held on the plates one opposite the other, that thereafter one of the plates is approached to the other plate by pivoting it about an axis parallel to the conveying direction, the position of the axis being selected in such a way that the glass sheet retained on the plate to be pivoted is lifted off the belt.

18. The method as defined in claim 17, wherein the plate is pivoted until it occupies a parallel position relative to the opposite plate.

19. The method as defined in claim 17, wherein the pivoting plate is additionally displaced in parallel and vertically to itself.

20. The method as defined in claim 19, wherein the pivoting plate is displaced in parallel to itself only after having been pivoted into a position parallel to the opposite plate.

21. The method as defined in claim 17 wherein the position of the axis, about which the one plate is pivoted, is selected in such a way that it lies below, instead of above, the upper run of the belt.

22. The method as defined in claim 17, wherein in their initial position in V form of the plates the upper run of the belt is arranged, relative to the plates, so that it encloses with both plates an angle greater than 90°.

23. The method as defined in claim 22, wherein in its initial position in V form the upper run of the belt encloses with the two plates angles of equal size.

24. The method as defined in claim 23, wherein the angle is selected to be between 95° and 100°.

25. The method as defined in claim 3, wherein two or more than two glass sheet pairs are arranged between the plates at equal distance one behind the other and are simultaneously filled with the gas different from air and joined to form insulating glass panes.

26. The method as defined in claim 25, wherein the two or more than two glass sheet pairs are arranged in V form and in pairs one opposite the other, wherein said glass sheet pairs are initially outside of the space defined by the plates and are subsequently transferred into the space between the plates in said arranged form.

27. The method as defined in claim 26, wherein the two or more than two pairs of glass sheets are transferred into the space between the plates simultaneously.

28. The method as defined in claim 2, wherein the upper run of the belt is supported over its length.

29. Device for assembling insulating glass panes that are filled with a gas different from air, comprising two plates, each plate having a lower edge and a bottom surface, wherein said plates can be varied with respect to their relative spacing, comprising a horizontal conveyor having a conveying direction, which uses a belt as a conveying element, arranged near a lower edges of the plates, comprising at least two seals which extend from an upper run of the belt to a point located above the belt and which are spaced one from the other in the conveying direction of the belt, at least one of the seals being active between the two plates and at least one of the plates being provided with means for holding a glass sheet on the plate, wherein the at least one plate and the belt can be moved one relative to the other in such a way that a lower edge of a glass sheet, being held on the plate, can be brought into a position spaced from the belt and that a structure is provided for supplying the gas different from air through the gap between the belt and the lower edge of the glass sheet held in the spaced position.

30. The device as defined in claim 29, wherein the belt is capable of being pivoted about an axis parallel to its conveying direction.

31. The device as defined in claim 29, wherein the plate, by means of which the spacing of the first glass sheet from the belt can be established, can be moved relative to the other plate and that the first glass sheet can be lifted off the belt by the movable plate on which it is retained.

32. The device as defined in claim 29, wherein the structure for supplying the gas different from air is provided on or in one of the plates.

33. The device as defined in claim 32, wherein the gas different from air can be supplied through that movable plate on which the first glass sheet is arranged.

34. The device as defined in claim 32, wherein one or more exit openings for the gas are provided at a bottom surface of the plate having the supplying structure.

35. The device as defined in claim 29, wherein a channel, extending in the conveying direction and being subdivided into separate sections, is provided for supplying the gas different from air, that the gas can be separately supplied to the sections of that channel and that each section of the channel communicates with an exit opening and such exit openings are located near the gap between the belt and said one glass sheet held in said spaced position.

36. The device as defined in claim 29, wherein a channel, extending in the conveying direction, is provided for supplying the gas different from air and that branch ducts, that can be shut off separately, lead from that channel to exit openings arranged near the gap between the belt and said glass sheet.

37. The device as defined in claim 32, wherein exit openings for the gas are arranged between a front surface of the plate and a seal provided on the bottom surface of the plate which extends in lengthwise direction and is directed against the belt.

38. The device as defined in claim 29, wherein a longitudinally extending seal is provided on the bottom surface of each of the plates (1*a*, 2*a*), between the two plates and the belt or a rail supporting the belt.

39. The device as defined in claim 29, wherein the upper run of the belt is supported by a rail over its length, which rail is connected solidly and in gastight fashion with one of the plates, said plate being a stationary plate.

40. The device as defined in claim 29, wherein the upper run of the belt is supported by a rail over its length, which rail projects laterally beyond the belt and carries on at least one side of the belt a seal which is directed against the bottom surface of a plate.

41. The device as defined in claim 37, wherein the seals consist of hoses.

42. The device as defined in claim 41, wherein the hoses can be inflated.

43. The device as defined in claim 32, wherein the plate, through which the gas different from air is supplied, comprises a slide between two exit openings for independently supplying the gas different from air, which slide extends transversely to the conveying direction from the surface of the plate to a longitudinally extending seal and can be displaced in a downward direction toward the belt.

44. The device as defined in claim 29, wherein among the seals, extending from the upper run of the belt to a point above the belt, a plurality of seals are provided in spaced relationship in vertical slots of one of the plates and can be moved into contact with the opposite plate individually and independently one from the other.

45. The device as defined in claim 44, wherein among the seals, extending from the upper run of the belt to a point above the belt, a plurality of seals are provided in spaced relationship in vertical slots of one of the plates and can be moved into contact with the opposite plate individually and independently one from the other, and wherein the seals arranged in the slots of the one plate are positioned opposite slides provided in the opposite plate.

46. The device as defined in claim 44, wherein the seals arranged in the slots of the one plate are strips that can be displaced in transverse direction.

47. The device as defined in claim 46, wherein the strips have a lower end carrying a brush with downwardly directed bristles.

48. The device as defined in claim 29, wherein among the seals, which extend in upward direction from the upper run of the belt, one seal is provided on one of an end of the two plates.

49. The method as defined in claim 17, wherein the two or more than two glass sheet pairs are arranged in V form and in pairs one opposite the other already outside of the space defined by the plates, and are transferred into the space between the plates in that arrangement.

50. The device as defined in claim 44, wherein the seals arranged in the slots of the one plate are positioned opposite the slides provided in the opposite plate.

* * * * *